US011774871B2

(12) United States Patent
Shiotari et al.

(10) Patent No.: US 11,774,871 B2
(45) Date of Patent: Oct. 3, 2023

(54) TONER AND METHOD FOR MANUFACTURING TONER

(71) Applicant: CANON KABUSHIKI KAISHA, Tokyo (JP)

(72) Inventors: Yoshiaki Shiotari, Shizuoka (JP); Hirofumi Kyuushima, Shizuoka (JP); Shintaro Noji, Shizuoka (JP); Kazutaka Sasaki, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 102 days.

(21) Appl. No.: 17/217,074

(22) Filed: Mar. 30, 2021

(65) Prior Publication Data

US 2021/0311405 A1 Oct. 7, 2021

(30) Foreign Application Priority Data

Apr. 6, 2020 (JP) ..... 2020-068617

(51) Int. Cl.
*G03G 9/087* (2006.01)
*G03G 9/08* (2006.01)

(52) U.S. Cl.
CPC ..... *G03G 9/0825* (2013.01); *G03G 9/0806* (2013.01); *G03G 9/0821* (2013.01); *G03G 9/0827* (2013.01); *G03G 9/08711* (2013.01); *G03G 9/08755* (2013.01); *G03G 9/08782* (2013.01)

(58) Field of Classification Search
None
See application file for complete search history.

(56) References Cited

U.S. PATENT DOCUMENTS

| | | | |
|---|---|---|---|
| 6,096,468 | A | 8/2000 | Ohno |
| 8,288,069 | B2 | 10/2012 | Fujikawa et al. |
| 8,323,726 | B2 | 12/2012 | Naka et al. |
| 8,986,914 | B2 | 3/2015 | Fujikawa et al. |
| 9,034,549 | B2 | 5/2015 | Shiotari et al. |
| 9,158,216 | B2 | 10/2015 | Shimano et al. |
| 9,256,148 | B2 | 2/2016 | Fujikawa et al. |
| 9,261,806 | B2 | 2/2016 | Moribe et al. |

(Continued)

FOREIGN PATENT DOCUMENTS

| | | | |
|---|---|---|---|
| JP | 2001-13732 | A | 1/2001 |
| JP | 2004246057 | A * | 9/2004 |

(Continued)

OTHER PUBLICATIONS

JP-2004246057-A translation (Year: 2022).*
U.S. Appl. No. 17/205,716, Naoya Isono, filed Mar. 18, 2021.

*Primary Examiner* — Peter L Vajda
(74) *Attorney, Agent, or Firm* — VENABLE LLP

(57) ABSTRACT

A toner comprising a toner particle, wherein the toner particle comprises a binder resin, the binder resin comprises a resin A and a resin B, the toner particle comprises protrusions on a surface thereof, each of the protrusions comprises the resin B, a shape factor SF-2 of the toner as observed under SEM is 105 to 120, and when the toner is observed under the SEM, a surface unevenness index of the toner as calculated by formula (1) below is 0.010 to 0.050:

Surface unevenness index=(area of region surrounded by convex hull of toner−projected area of toner)/projected area of toner (1).

8 Claims, 1 Drawing Sheet

(56) References Cited

U.S. PATENT DOCUMENTS

| | | | | |
|---|---|---|---|---|
| 9,285,697 | B2 | 3/2016 | Fukudome et al. | |
| 9,377,705 | B2 | 6/2016 | Shimano et al. | |
| 9,383,668 | B2 | 7/2016 | Noji et al. | |
| 9,500,972 | B2 | 11/2016 | Tanaka et al. | |
| 9,575,424 | B2 | 2/2017 | Nakagawa et al. | |
| 9,594,323 | B2 | 3/2017 | Fujikawa et al. | |
| 9,599,919 | B2 | 3/2017 | Isono et al. | |
| 9,785,068 | B2 | 10/2017 | Umeda et al. | |
| 9,829,816 | B2 | 11/2017 | Tanaka et al. | |
| 9,835,964 | B2 | 12/2017 | Yoshida et al. | |
| 10,747,136 | B2 | 8/2020 | Kenmoku et al. | |
| 2011/0229815 | A1 | 9/2011 | Kubo | |
| 2015/0248072 | A1 | 9/2015 | Katsuta et al. | |
| 2015/0277251 | A1* | 10/2015 | Tominaga | G03G 9/08762 430/137.11 |
| 2015/0277257 | A1* | 10/2015 | Uno | G03G 9/093 430/114 |
| 2015/0286157 | A1* | 10/2015 | Masumoto | G03G 9/0806 430/108.4 |
| 2020/0363742 | A1 | 11/2020 | Kyuushima et al. | |

FOREIGN PATENT DOCUMENTS

| | | | |
|---|---|---|---|
| JP | 2011-197160 | A | 10/2011 |
| JP | 2013-64965 | A | 4/2013 |

* cited by examiner

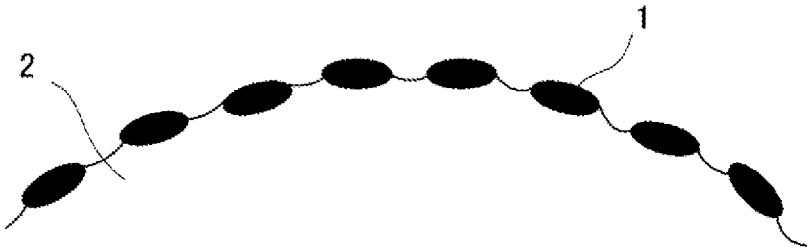
1
2

TONER AND METHOD FOR MANUFACTURING TONER

BACKGROUND OF THE INVENTION

Field of the Invention

The present disclosure relates to a toner for use in forming toner images by developing electrostatic latent images formed by methods such as an electrophotographic method, an electrostatic recording method and a toner jet recording method, and to a method for manufacturing the toner.

Description of the Related Art

Electrophotographic technology used in copiers, printers, facsimile receivers and the like is subject to increasing demands from users every year as the apparatuses continue to develop. In terms of recent trends, there is now strong demand for stable image quality independent of environment because the range of usage environments has increased as the market has expanded. There is also strong demand for designs that are compact but are also capable of long-term printing.

To satisfy these demands, an electrophotographic process must (1) not undergo changes in developing performance (high durability) and (2) transfer a latent image to a recording medium without disturbing the latent image (high transferability). This means that the toner has to have high durability and high transferability, and many improvements have been aimed at solving these problems.

To attain high transferability, the attachment force between the toner and the transfer member has been controlled by controlling the shape of the toner particle. For example, Japanese Patent Application Publication Nos. 2001-013732, 2011-197160 and 2013-064965 disclose toners in which the shape factor SF-2 of the toner particle is controlled.

SUMMARY OF THE INVENTION

In Japanese Patent Application Publication No. 2001-013732, a nearly spherical toner is obtained because the toner particle is prepared by an ordinary suspension polymerization method. Because such a toner rolls easily in the developing device, the toner tends to be overcharged and the charge quantity tends to rise excessively in low-temperature low-humidity environments.

As a result, the attachment force between the toner and the toner carrying member that supplies the toner increases during the second half of long-term continuous use, and large quantities of undeveloped toner remain on the carrying member. When a new toner is supplied to the carrying member in this state, it becomes difficult to regulate the toner on the carrying member, and image fogging and contamination of the member may occur as a result.

In Japanese Patent Application Publication Nos. 2011-197160 and 2013-064965, because a powdered toner is mechanically spheronized or particles of a certain size are aggregated to obtain toner particles, the toner particles include a wide range of shapes from round shapes to those with extremely uneven surfaces. This may cause variations in fine line reproducibility. When such toner particles with a wide range of shapes are mixed, because the flowability differs depending on the toner shape, the charge quantity of the toner with high flowability is likely to increase while the charge quantity of the toner with low flowability is less likely to increase. As a result, the toner tends to have a broad charge quantity distribution, and image fogging and contamination of the member may occur as a result.

Thus, the toners of Japanese Patent Application Publication Nos. 2001-013732, 2011-197160 and 2013-064965 all have room for improvement. The present disclosure therefore provides a toner whereby favorable fine line reproducibility can be obtained even during long-term printing regardless of the usage environment, and whereby image fogging and contamination of a member can be reduced to yield stable high-quality images, together with a method for manufacturing the toner.

The present disclosure is a toner comprising a toner particle, wherein the toner particle comprises a binder resin, the binder resin comprises a resin A and a resin B, the toner particle comprises protrusions on a surface thereof, each of the protrusions comprises the resin B, a shape factor SF-2 of the toner as observed under a scanning electron microscope is 105 to 120, and when the toner is observed under the scanning electron microscope, a surface unevenness index of the toner as calculated by formula (1) below is 0.010 to 0.050:

$$\text{Surface unevenness index} = (\text{area of region surrounded by convex hull of toner} - \text{projected area of toner})/\text{projected area of toner} \quad (1).$$

The present disclosure is a method for manufacturing a toner comprising a toner particle, wherein the toner particle comprises a binder resin, the binder resin comprises resin A and a resin B, the toner particle comprises protrusions on a surface thereof, each of the protrusions comprises the resin B, a shape factor SF-2 of the toner as observed under a scanning electron microscope is 105 to 120, and when the toner is observed under the scanning electron microscope, a surface unevenness index of the toner as calculated by formula (1) below is 0.010 to 0.050, the manufacturing method comprising:

a step (I) of forming particles of a polymerizable monomer composition comprising the resin B and a polymerizable monomer for forming the resin A in an aqueous medium, a step (II) of polymerizing in the aqueous medium the polymerizable monomer contained in the particles of the polymerizable monomer composition to form a resin particle, and a step (III) of maintaining the resin particle at a temperature of at least a glass transition temperature of the resin B in an aqueous medium having a pH higher than an acid dissociation constant pKa of the resin B:

$$\text{Surface unevenness index} = (\text{area of region surrounded by convex hull of toner} - \text{projected area of toner})/\text{projected area of toner} \quad (1).$$

According to the present disclosure, a toner whereby favorable fine line reproducibility can be obtained even during long-term printing regardless of the usage environment, and whereby image fogging and contamination of a member can be reduced to yield stable high-quality images, together with a method for manufacturing the toner, can be provided.

Further features of the present invention will become apparent from the following description of exemplary embodiments with reference to the attached drawings.

BRIEF DESCRIPTION OF THE DRAWINGS

The FIGURE shows the condition of the toner particle surface.

DESCRIPTION OF THE EMBODIMENTS

Unless otherwise specified, representations of numerical ranges such as "from XX to YY" or "XX to YY" in this Description indicate numerical ranges including the numbers at the upper and lower ends of the range. When a numerical range is described in stages, the upper and lower limits of each numerical range may be combined arbitrarily.

(Meth)acrylic acid means acrylic acid, methacrylic acid, or both acrylic acid and methacrylic acid. Similarly, a (meth)acrylic acid ester means an acrylic acid ester, a methacrylic acid ester or both an acrylic acid ester and a methacrylic acid ester.

The symbols in the drawings are defined as follows.

1: Resin B, 2: Resin A

A "monomer unit" is a reacted form of a monomer substance in a polymer. For example, one carbon-carbon bonded section of a principal chain obtained by polymerizing a vinyl monomer in a polymer may be called one unit. A vinyl monomer may be represented by the following formula (Z).

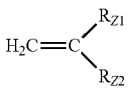

(Z)

In formula (Z), $R_{Z1}$ represents a hydrogen atom or an alkyl group (preferably a $C_{1-3}$ alkyl group, or more preferably a methyl group), and $R_{Z2}$ represents any substituent.

Embodiments of these disclosures are explained in detail below, but the disclosures are not limited thereby.

The toner is a toner comprising a toner particle, wherein the toner particle comprises a binder resin, the binder resin comprises a resin A and a resin B, the toner particle comprises protrusions on a surface thereof, each of the protrusions comprises the resin B, a shape factor SF-2 of the toner as observed under a scanning electron microscope is 105 to 120, and when the toner is observed under the scanning electron microscope, a surface unevenness index of the toner as calculated by formula (1) below is 0.010 to 0.050:

Surface unevenness index=(area of region surrounded by convex hull of toner−projected area of toner)/projected area of toner (1).

The inventors discovered as a result of earnest research that a toner with excellent transferability and an optimal charge quantity could be obtained with the above configuration. Using this toner, it is possible to reduce image fogging and contamination of the member and obtained stable high-quality images with good fine line reproducibility even during long-term printing regardless of the use environment. The inventors believe that these effects are obtained for the following reasons.

To achieve excellent fine line reproducibility, it is necessary to improve transfer efficiency, and a toner with few contact points is preferable. For this reason, the shape factor SF-2 of the toner as observed by scanning electron microscopy is from 105 to 120. This shape factor SF-2 is preferably from 107 to 118, or more preferably from 110 to 116.

If this shape factor SF-2 is less than 105, image fogging is likely to occur because the charge quantity tends to rise excessively. If the shape factor SF-2 exceeds 120, on the other hand, fine line reproducibility tends to decline.

The shape factor SF-2 is a shape factor determined by the following formula.

SF-2=(projected perimeter of toner)2/(projected area of toner)/4π×100 (formula)

That is, the shape factor SF-2 is the ratio of the projected area of a spherical particle having the same perimeter as the toner to the projected area of the toner, represented as a percentage.

To optimize the charge quantity of the toner, on the other hand, it is necessary to obtain a sharp charge quantity distribution without raising the charge quantity excessively. Because toner flowability needs to be reduced to a suitable degree to prevent the charge quantity from rising excessively, the roundness of the toner must be reduced to a suitable degree. To give the toner a sharp charge quantity distribution, moreover, it is important that the individual particles of the toner 1 have uniform flowability, or in other words that the toner shapes are uniform.

Even in toner having the same shape factor SF-2, the surface shapes of the particles may differ. That is, the value of the shape factor SF-2 may be the same in toner having extreme surface unevenness and toner having many small particles or the like adhering thereto. In such cases, because the toner shapes are not uniform the toner that rolls more easily is likely to acquire a higher charge quantity, while the toner that rolls less easily is likely to acquire a lower charge quantity. The charge quantity distribution of the toner is likely to be broad as a result. Image fogging and contamination of the member are likely if the charge quantity distribution is too broad in this way.

To eliminate this variation in toner shape, it is necessary to consider the surface unevenness index represented by formula (1) below as well as the shape factor SF-2.

Surface unevenness index=(area of region surrounded by convex hull of toner−projected area of toner)/projected area of toner (1)

The specific analysis methods are described below, but unlike the shape factor SF-2, this surface unevenness index numerically represents the degree to which the toner surface is uneven. This means that even in toners with the same shape factors SF-2, this surface unevenness index can be used to discern whether the toner surface has multiple small projections and indentations, or only a very few extreme depressions, or multiple fine particles adhering to the surface thereof.

With the toner of these disclosures, image fogging associated with a broad distribution of toner charge quantity is improved while at the same time fine line reproducibility is maintained because the toner surface has multiple small projections and indentations on its surface. That is, the surface unevenness index as calculated by the above formula (1) from toner observed under a scanning electron microscope is from 0.010 to 0.050.

If the surface unevenness index is less than 0.010, this means that the toner surface does not have sufficient projections and indentations, resulting in excessive toner charging. This increases the likelihood of image fogging during long-term continuous use. If the surface unevenness index exceeds 0.050, on the other hand, this suggests that the toner surface is extremely pitted or has fine particles or the like attached thereto, which means that fine line reproducibility is likely to be reduced, and also that the toner is likely to have a broad charge quantity distribution. Image fogging and contamination of the member are likely to occur as a result. The surface unevenness index is preferably from 0.015 to 0.045, or more preferably from 0.024 to 0.040.

The standard deviation of the surface unevenness index of the toner is preferably not more than 0.010 or more preferably not more than 0.005 from the standpoint of further enhancing these effects.

To further enhance these effects, the shape coefficient SF-1 of the toner as observed under a scanning electron microscope is preferably at least 105. To enhance these effects while at the same time combatting paper fogging associated with positive fog in high-temperature high-humidity environments and reducing melt adhesion to the developer blade, this shape factor SF-1 is preferably not more than 120 or more preferably not more than 112.

The shape factor SF-1 is determined by the following formula.

$$\text{SF-1}=(\text{projected maximum length of toner})2/(\text{projected area of toner})\times(\pi/4)\times 100 \quad \text{(formula)}$$

The toner of the invention is a toner having a toner particle containing a binder resin, wherein the binder resin contains a resin A and a resin B, the toner particle comprises protrusions on a surface thereof, and each of the protrusions comprises the resin B. The resin B may form protrusions on the surface of the toner particle. To obtain the numerical ranges for the shape factor SF-2 and the surface unevenness index calculated by formula (1), it is sufficient that the resin A and the resin B are included in the binder resin forming the toner particle, protrusions are formed on a surface the toner particle and that the resin B is included in the protrusions. Alternatively, the resin B may form protrusions on the surface of the toner particle. The FIGURE shows the condition of the toner particle surface. 1 in the FIGURE represents resin B, and 2 represents resin A.

For ease of manufacture, preferably the resin A contains a styrene (meth)acrylic resin and the resin B contains a polyester resin. That is, preferably the protrusions on the toner particle surface contain a polyester resin, while the indentations apart from the protrusions on the toner particle surface contain a styrene (meth)acrylic resin.

Furthermore, preferably the content of the polyester resin per 100.0 mass parts of the polymerizable monomer for forming the resin A or the content of the polyester resin per 100.0 mass parts of the resin A is from 3.0 mass parts to 15.0 mass parts because this allows many protrusions and indentations to be formed, and more preferably is from 3.0 mass parts to 10.0 mass parts so that many protrusions and indentations can be formed uniformly.

Preferably the toner particle contains a wax, and in a toner cross-section observed under a transmission electron microscope, given As as the occupied area percentage of the wax in a region defined by the contour of the toner and a line drawn 1.0 μm from the contour in the direction of the toner interior and Ac as the occupied area percentage of the wax in the interior region inwards from the line drawn 1.0 μm from the contour in the direction of the toner interior, these As and Ac preferably satisfy the following formula (2), and more preferably satisfy the following formula (2)'. The occupied area percentage of the wax can be controlled within the desired range by appropriately adjusting the toner manufacturing conditions as described below.

$$50.0 \geq [As/(Ac+As)]\times 100 \geq 3.0 \quad (2)$$

$$20.0 \geq [As/(Ac+As)]\times 100 \geq 5.0 \quad (2)'$$

If $[As/(Ac+As)]\times 100$ is within the range, fixability can be maintained while controlling contamination of the member by the wax and toner melt adhesion.

Methods for manufacturing the toner are explained below, but the methods are not limited to these. The method for manufacturing a toner of the present disclosure is a method for manufacturing a toner comprising a toner particle, wherein the toner particle comprises a binder resin, the binder resin comprises resin A and a resin B, the toner particle comprises protrusions on a surface thereof, each of the protrusions comprises the resin B, a shape factor SF-2 of the toner as observed under a scanning electron microscope is 105 to 120, and when the toner is observed under the scanning electron microscope, a surface unevenness index of the toner as calculated by formula (1) below is 0.010 to 0.050, the manufacturing method comprising:

a step (I) of forming particles of a polymerizable monomer composition comprising the resin B and a polymerizable monomer for forming the resin A in an aqueous medium, a step (II) of polymerizing in the aqueous medium the polymerizable monomer contained in the particles of the polymerizable monomer composition to form a resin particle, and a step (III) of maintaining the resin particle at a temperature of at least a glass transition temperature of the resin B in an aqueous medium having a pH higher than an acid dissociation constant pKa of the resin B:

$$\text{Surface unevenness index}=(\text{area of region surrounded by convex hull of toner}-\text{projected area of toner})/\text{projected area of toner} \quad (1).$$

When such suspension polymerization is performed, the orientation of the resin B towards the interfaces of the toner particles in the aqueous medium is much different below and above the acid dissociation constant pKa of the resin B. That is, when a step associated with suspension polymerization is performed in an aqueous medium having a pH greater than the acid dissociation constant pKa of the resin B, the resin B tends to move to the interfaces.

To preferentially locate the resin B at the surface of the toner particle, therefore, a resin particle obtained by polymerization may be held in an aqueous medium having a pH higher than the acid dissociation constant pKa of the resin B. Furthermore, in terms of the aqueous medium pH and the resin B acid dissociation constant pKa, preferably the value of (aqueous medium pH)−(resin B acid dissociation constant pKa) is preferably from 1.3 to 5.0, or more preferably from 3.5 to 4.5.

Because the resin B is a polymer, moreover, its molecular movement in the toner particle is slow. In an aqueous medium having a pH higher than the acid dissociation constant pKa of the resin B, therefore, the temperature is maintained at at least the glass transition temperature (Tg) of the resin B. It is thus possible to positively cause the resin B to be preferentially located on the toner particle surface. As a result, the resin B can be included in protrusions when the toner particle comprises the protrusions on the surface thereof. In addition, the resin B forms protrusions on the surface of the toner particle. The holding temperature is preferably at least 10° C. higher than the glass transition temperature (Tg) of the resin B, or more preferably at least 15° C. higher than the glass transition temperature (Tg) of the resin B. The upper limit of this holding temperature is not particularly specified, but is not more than about 30° C. higher than the glass transition temperature (Tg) of the resin B.

To partially and positively cause the resin B to be preferentially located on the surface, the holding time is preferably from 30 minutes to 6 hours, or more preferably from 1 hour to 5 hours. The value of the surface unevenness index can be increased by increasing this holding time. The pH of the aqueous medium in the steps before this holding step (III), or in other words in the step (I) and/or step (II), is preferably less than the acid dissociation constant pKa of the resin B so as to preferentially locate the resin B to a suitable extent on the toner particle surface.

For ease of manufacture, for example the resin B for being included in protrusions on the toner particle surface or forming protrusions on the toner particle surface preferably contains a polyester resin. When suspension polymerization is performed as described above, the orientation towards the interfaces of the toner particles in the aqueous medium is much different below and above the acid dissociation constant pKa of the polyester resin because the polyester resin has carboxyl groups. That is, the polyester moves towards the interfaces when maintained at at least a temperature of the glass transition temperature of the polyester resin in an aqueous medium having a pH higher than the acid dissociation constant pKa of the polyester resin.

Thus, the polyester resin can be preferentially located on the toner particle surface by setting the pH in the aqueous medium in step (III) higher than the acid dissociation constant pKa of the polyester resin. Because the polyester resin is a polymer, moreover, its molecular movement in the toner particle is slow. It is thus possible to cause the polyester resin to be located preferentially on the toner particle surface by maintaining a temperature at at least the glass transition temperature (Tg) of the polyester resin. Protrusions of the polyester resin on the toner particle surface can be formed as a result.

Specifically, when a polyester resin with an acid dissociation constant pKa of less than 6.5 is used as the resin B, the pH of the aqueous medium can be set at from 6.5 to 10.0 and the temperature may be maintained at at least the glass transition temperature (Tg) of the polyester resin in the step (III). The holding time is preferably from 30 minutes to 6 hours or more preferably from 1 hour to 5 hours to partially and positively cause preferential location of the polyester resin. The pH of the aqueous medium in the steps before this holding step (III), or in other words in the step (I) and/or step (II), is preferably less than the acid dissociation constant pKa of the polyester resin so as to appropriately expose the polyester resin on the surface.

The acid value of the resin B is preferably at least 10 mg KOH/g, or more preferably at least 14 mg KOH/g. This acid value is also preferably not more than 20 mg KOH/g. If the acid value of the resin B is at least 10 mg KOH/g, the number of acid dissociation part increases, making it easier to preferentially locate the resin B on the toner particle surface. An acid value of not more than 20 mg KOH/g is preferred for suppressing image fogging in high-temperature high-humidity environments (HH).

The resin A preferably contains a vinyl resin, and more preferably contains a styrene (meth)acrylic resin. Preferably the resin A contains a styrene (meth)acrylic resin while the resin B contains a polyester resin, and more preferably the resin A is a styrene (meth)acrylic resin while the resin B is a polyester resin.

The content of the polyester resin per 100.0 mass parts of the polymerizable monomer for forming the resin A or the content of the polyester resin per 100.0 mass parts of the resin A is preferably from 3.0 mass parts to 15.0 mass parts because this allows many protrusions and indentations to be formed, and more preferably is from 3.0 mass parts to 10.0 mass parts so that many protrusions and indentations can be formed uniformly.

The vinyl resin is a resin obtained by radical polymerization of a monomer having a vinyl group (hereunder also called simply a "vinyl monomer"). The vinyl resin may be a homopolymer obtained by polymerizing one kind of vinyl monomer, or a copolymer obtained by polymerizing at least two kinds of vinyl monomer.

Examples of the vinyl resin include homopolymers of monomers including monomers with styrene skeletons (such as styrene, p-chlorostyrene, α-methylstyrene and the like), monomers with (meth)acrylic acid ester skeletons (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate and the like), monomers with ethylenically unsaturated nitrile skeletons (such as acrylonitrile, methacrylonitrile and the like), monomers with vinyl ether skeletons (such as vinyl methyl ether, vinyl isobutyl ether and the like), monomers with vinyl ketone skeletons (such as vinyl methyl ketone, vinyl ethyl ketone, vinyl isopropenyl ketone and the like), monomers with olefin skeletons (such as ethylene, propylene, and butadiene) and the like, and copolymers combining at least two of these monomers for example.

The styrene (meth)acrylic resin is preferably a resin obtained by copolymerizing a monomer having a styrene skeleton with a monomer having a (meth)acrylic acid ester skeleton. This styrene (meth)acrylic resin is preferably a copolymer obtained by copolymerizing at least a monomer having a styrene skeleton and a monomer having a (meth) acryloyl group. The meaning of "(meth)acrylic" above encompasses both acrylic acid and methacrylic acid. Similarly, the meaning of "(meth)acryloyl" above encompasses both acryloyl and methacryloyl groups.

Examples of monomers with styrene skeletons (hereunder also called "styrene monomers") include styrene, alkyl-substituted styrenes (such as α-methyl styrene, 2-methyl styrene, 3-methyl styrene, 4-methylstyrene, 2-ethyl styrene, 3-ethylstyrene and 4-ethylstyrene), halogen-substituted styrenes (such as 2-chlorostyrene, 3-chlorostyrene and 4-chlorostyrene), and vinyl naphthalene and the like. One styrene monomer alone or a combination of at least two may be used. Of these, styrene is preferred as a styrene monomer for ease of reaction, ease of reaction control and availability.

Examples of monomers having (meth)acryloyl groups (hereunder also called "(meth)acrylic monomers") include (meth)acrylic acid and (meth)acrylic acid esters. Examples of (meth)acrylic acid esters include (meth)acrylic acid alkyl esters (such as n-methyl (meth)acrylate, n-ethyl (meth) acrylate, n-propyl (meth)acrylate, n-butyl (meth)acrylate, n-pentyl (meth)acrylate, n-hexyl acrylate, n-heptyl (meth) acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, t-butyl (meth)acrylate, isopentyl (meth) acrylate, amyl (meth)acrylate, neopentyl (meth)acrylate, isohexyl (meth)acrylate, isoheptyl (meth)acrylate, isooctyl (meth)acrylate, 2-ethylhexyl (meth)acrylate, cyclohexyl (meth)acrylate and t-butylcyclohexyl (meth)acrylate), (meth)acrylic acid aryl esters (such as phenyl (meth)acrylate, biphenyl (meth)acrylate, diphenylethyl (meth)acrylate, t-butylphenyl (meth)acrylate and terphenyl (meth)acrylate), and dimethylaminoethyl (meth)acrylate, diethylaminoethyl (meth)acrylate, methoxyethyl (meth)acrylate, 2-hydroxyethyl (meth)acrylate, β-carboxyethyl (meth)acrylate, (meth) acrylamide and the like. One (meth)acrylic acid monomer alone or a combination of at least two may be used.

The polymerizable monomer described below is preferably a copolymer of a monomer having a styrene skeleton (styrene monomer) and a monomer having a (meth)acrylic acid ester skeleton ((meth)acrylic monomer) so as to partially locate the polyester resin on the toner particle surface.

The copolymerization ratio of the styrene monomer and the (meth)acrylic monomer (by mass, styrene monomer/(meth)acrylic monomer) is from 85/15 to 70/30 for example.

An amorphous polyester resin is preferred as the polyester resin. An amorphous polyester resin can also confer heat-resistant storability. A DSC measurement unit can be used to determine whether or not a resin is amorphous by specifying whether or not it has a melting point.

The polyester resin is preferably a condensation polymer of a polyhydric alcohol and a polyvalent carboxylic acid. Examples of the polyhydric alcohol include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexane dimethanol, butenediol, octenediol, cyclohexene dimethanol, isosorbitol, hydrogenated bisphenol A, bisphenol A ethylene oxide adduct, and bisphenol A propylene oxide adduct.

Examples of the polyvalent carboxylic acid include benzenedicarboxylic acids and anhydrides such as phthalic acid, terephthalic acid, isophthalic acid "IPA") and anhydrous phthalic acid; and alkyldicarboxylic acids such as succinic acid, adipic acid, sebacic acid and azelaic acid, and anhydrides thereof.

The content of the resin A in the binder resin is preferably from 80 mass % to 98 mass %, or more preferably from 90 mass % to 95 mass %. The content of the resin B in the binder resin is preferably from 2 mass % to 20 mass %, or more preferably from 4 mass % to 10 mass %. The content ratio of the resin A and resin B (by mass, resin A/resin B) is preferably from 5 to 50, or more preferably from 10 to 30.

The toner manufacturing method is explained in more detail below, but the method is not limited thereby. The toner manufacturing method comprises:

a step (I) in which particles of a polymerizable monomer composition containing the resin B and a polymerizable monomer for forming the resin A are formed in an aqueous medium, a step (II) in which the polymerizable monomer contained in the particles of the polymerizable monomer composition is polymerized in an aqueous medium to form resin particles, and a step (III) in which the resulting resin particles are held in an aqueous medium having a pH higher than the acid dissociation constant pKa of the resin B at at least a temperature of the glass transition temperature of the resin B.

In the step (I), the polymerizable monomer composition may contain the resin B and a polymerizable monomer for forming the resin A, together with additives such as a colorant, a wax, a polymerization initiator, a charge control agent, a chain transfer agent, a polymerization inhibitor and a crosslinking agent and the like as necessary.

The resulting polymerizable monomer composition is dispersed in an aqueous medium to form particles of the polymerizable monomer composition containing the resin B, the polymerizable monomer for forming the resin A and the like.

The aqueous medium may contain a hardly soluble inorganic fine particle as a dispersant.

The aqueous medium containing the hardly soluble inorganic fine particle may be configured to contain a hardly soluble inorganic fine particle and an aqueous medium containing water. In addition to the hardly soluble inorganic fine particle, the aqueous medium may also contain a counterion generated when producing the hardly soluble inorganic fine particle and an acid (such as hydrochloric acid or sulfuric acid) or alkali (such as sodium hydroxide or sodium carbonate) added to adjust the pH and the like.

The water used in preparing the aqueous medium may be deionized water for example. The aqueous medium is preferably prepared using at least 100 mass parts of water per 100 mass parts of the polymerizable monomer. If the amount of water used is at least 100 mass parts, oil droplets (particles of the polymerizable monomer composition) can be easily formed without causing oil-water reversal.

The hardly soluble inorganic fine particle serves as a dispersion stabilizer for the particles of the polymerizable monomer composition in the aqueous medium. The hardly soluble inorganic fine particle may for example be a particle that has extremely low solubility (measurement temperature: 60° C.) in water within a specific pH range (such as from 4.0 to 10.0) and has a number-average particle diameter of not more than 1.0 μm.

For the dispersion stabilizer, inorganic and organic dispersion stabilizers are well known, but an inorganic dispersion stabilizer is preferred. This may also be combined with an organic dispersion stabilizer (such as a surfactant).

Examples of the hardly soluble inorganic fine particle include fine particles of calcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, alumina and the like. Of these, calcium phosphate may be used because of the ease of controlling the particle diameter. One kind of hardly soluble inorganic fine particle or a combination of multiple kinds may be used.

When preparing the aqueous solution containing the hardly soluble inorganic fine particle, a commercial dispersion stabilizer may be used as is and dispersed in water as the hardly soluble inorganic fine particle. To obtain a hardly soluble inorganic fine particle having a fine uniform particle diameter, however, the hardly soluble inorganic fine particle may also be produced under high-speed stirring in water.

For example, when a hardly soluble inorganic fine particle of calcium phosphate is used, it may be prepared as follows. A sodium phosphate aqueous solution and a calcium chloride aqueous solution are mixed under high-speed stirring at a low-temperature range of not more than 60° C. to form fine particles of calcium phosphate in water and obtain the hardly soluble inorganic fine particle.

The polymerizable monomer composition is then dispersed in the aqueous medium containing the hardly soluble inorganic fine particle, and particles of the polymerizable monomer composition are granulated. It is thus possible to obtain a dispersion containing particles of the polymerizable monomer composition together with a hardly soluble inorganic fine particle that functions as a dispersion stabilizer. A stirring apparatus such as a TK Homomixer (product name, Tokushu Kika) may be used when forming the particles of the polymerizable monomer composition.

The step (II) is a step of polymerizing the polymerizable monomer contained in the resulting particles of the polymerizable monomer composition in water to form resin particles. Either or both of an oil-soluble polymerization initiator and a water-soluble polymerization initiator may be used as a polymerization initiator during polymerization.

Examples of the oil-soluble polymerization initiator include nitrile polymerization initiators such as 2,2'-azobisisobutyronitrile, 2,2'-azobis-2,4-dimethylvaleronitrile, 1,1'-azobis(cyclohexane-1-carbonitrile) and 2,2'-azobis-4-methoxy-2,4-dimethylvaleronitrile; and peroxide polymerization initiators such as acetylcyclohexyl sulfonyl peroxide, diisopropyl peroxycarbonate, decanonyl peroxide, lauroyl peroxide, stearoyl peroxide, propionyl peroxide, acetyl peroxide, t-butylperoxy-2-ethylhexanoate, benzoyl peroxide, t-butyl peroxypivalate, t-butyl peroxyisobutyrate, cyclohexanone peroxide, methyl ethyl ketone peroxide, dicumyl peroxide, t-butyl hydroperoxide, di-t-butyl peroxide, cumene hydroperoxide and the like.

Examples of the water-soluble polymerization initiator include aluminum persulfate, potassium persulfate, 2,2'-azobis(N,N'-dimethylene isobutyroamidine) hydrochloride, 2,2'-azobis(2-aminodinopropane) hydrochloride, azobis (isobutylamidine) hydrochloride, 2,2'-azobisisobutyronitrile sodium sulfonate, ferrous sulfate and hydrogen peroxide.

From the standpoint of safety and polymerization efficiency, the added amount of the polymerization initiator is preferably from 0.1 mass parts to 20 mass parts, or more preferably from 0.1 mass parts to 15 mass parts per 100 mass parts of the polymerizable monomer. One kind of polymerization initiator or a mixture of at least two kinds may be used with reference to the 10-hour half-life temperature of each.

A crosslinking agent may be used when polymerizing the polymerizable monomer to increase the stress resistance of the toner particle and control the molecular weights of the constituent molecules of the toner particle. A compound having at least two polymerizable double bonds may be used as the crosslinking agent. Specific examples include aromatic divinyl compounds such as divinyl benzene and divinyl naphthalene; carboxylic acid esters having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least 3 vinyl groups.

One kind of crosslinking agent alone or a mixture of at least two kinds may be used. From the standpoint of toner fixing performance and offset resistance, the added amount of the crosslinking agent is preferably from 0.05 mass parts to 10 mass parts, or more preferably from 0.10 mass parts to 5 mass parts per 100 mass parts of the polymerizable monomer.

A chain transfer agent and a polymerization inhibitor may also be used to control the degree of polymerization of the polymerizable monomer. Examples of the chain transfer agent include α-methylstyrene dimer, t-dodecylmercaptane, n-dodecylmercaptane, n-octylmercaptane, carbon tetrachloride, carbon tetrabromide and the like.

Examples of the polymerization inhibitor include quinone compounds such as p-benzoquinonem, chloraniline, anthraquinone, phenanthquinone and dichlorobenzoquinone, organic hydroxy compounds such as phenol, tertiary butyl catechol, hydroquinone, catechol and hydroxymonomethyl ether, nitro compounds such as dinitrobenzene, dinitrotoluene and dinitrophenol, nitroso compounds such as nitrosobenzene and nitrosonaphthol, amino compounds such as methyl aniline, p-phenylenediamine, N,N'-tetraethyl-p-phenylenediamine and diphenylamine, and organic sulfur compounds such as tetraalkyluram disulfide and dithiobenzoyl disulfide and the like.

The toner particle may also contain a colorant. This colorant may be selected appropriately from well-known colorants in the toner field out of considerations of hue angle, chroma, brightness, weather resistance, OHT transparency, dispersibility in the toner particle and the like. Specifically, the black, yellow, magenta and cyan pigments described below may be used, as well as dyes and other colorants as necessary. One kind of colorant or a mixture of multiple kinds may be used. The colorants may also be used in a solid solution.

The content of the colorant is preferably from 1 mass part to 20 mass parts per 100 mass parts of the binder resin. For purposes of dispersing the pigment or other colorant in the toner particle, the colorant may be used dispersed in a solvent, and a polymerizable monomer (such as styrene) may be used as this solvent.

A known black colorant in the toner field may be used as a black colorant. Specific examples of black colorants include carbon black and blacks obtained by blending the yellow, magenta and cyan colorants described below.

The carbon black is not particularly limited but may be a carbon black obtained by a manufacturing method such as a thermal method, acetylene method, channel method, furnace method, lamp black method or the like. One kind of carbon black or a mixture of at least two kinds may be used. The carbon black may be a crude pigment, or may be a prepared pigment composition as long as this does not significantly inhibit the effect of the pigment dispersant. The number-average particle diameter of the primary particles of the carbon black is not particularly limited, but is preferably from 14 nm to 80 nm, or more preferably from 25 nm to 50 nm.

A known yellow colorant in the toner field may be used as a yellow colorant. Condensed polycyclic pigments, isoindolinone compounds, anthraquinone compounds, azo metal complexes, methine compounds and allylamide compounds are typical examples of pigment-type yellow colorants. Specific examples include C.I. pigment yellow 3, 7, 10, 12, 13, 14, 15, 17, 23, 24, 60, 62, 74, 75, 83, 93, 94, 95, 99, 100, 101, 104, 108, 109, 110, 111, 117, 123, 128, 129, 138, 139, 147, 148, 150, 155, 166, 168, 169, 177, 179, 180, 181, 183, 185, 191:1, 191, 192, 193 and 199. Examples of dye-type yellow colorants include C.I. solvent yellow 33, 56, 79, 82, 93, 112, 162 and 163 and C.I. disperse yellow 42, 64, 201 and 211.

A known magenta colorant in the toner field may be used as a magenta colorant. Examples of magenta colorants include condensed polycyclic pigments, diketopyrrolopyrrole compounds, anthraquinone compound, quinacridone compounds, basic dye lake compounds, naphthol compounds, benzimidazolone compounds, thioindigo compounds and perylene compounds. Specific examples include C.I. pigment red 2, 3, 5, 6, 7, 23, 48:2, 48:3, 48:4, 57:1, 81:1, 122, 146, 150, 166, 169, 177, 184, 185, 202, 206, 220, 221, 238, 254 and 269 and C.I. pigment violet 19.

A known cyan colorant in the toner field may be used as a cyan colorant. Examples of cyan colorants include phthalocyanine compounds and derivatives thereof, anthraquinone compounds, and basic dye lake compounds. Specific examples include C.I. pigment blue 1, 7, 15, 15:1, 15:2, 15:3, 15:4, 60, 62 and 66.

The toner particle may also contain a wax. Examples of the wax include aliphatic hydrocarbon waxes such as low-molecular-weight polyethylene, low-molecular-weight polypropylene, microcrystalline wax, Fischer-Tropsch wax and paraffin wax; aliphatic hydrocarbon wax oxides such as polyethylene oxide wax, and block copolymers of these; waxes consisting primarily of fatty acid esters, such as carnauba wax and montanic acid ester wax, and partially or fully deoxidized fatty acid esters such as deoxidized carnauba wax; saturated linear fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; fatty acid amides such as linoleamide, oleamide and lauramide; saturated fatty acid bisamides such as methylene bis-stearamide, ethylene bis-caproamide, ethylene bis-lauramide and hexamethylene bis-stearamide; unsaturated fatty acid amides such as ethylene bis-oleamide, hexamethylene bis-oleamide, N,N'-dioleyl adipamide and N,N'-dioleyl sebacamide; aromatic bisamides such as m-xylene bis-stearamide and N,N'-distearyl isophthalamide; alphatic metal salts (generally called metal soaps) such as calcium stearate, calcium laurate, zinc stearate and magnesium stearate; waxes obtained by grafting aliphatic hydrocarbon waxes with vinyl monomers such as styrene or acrylic acid; partial esters of fatty acids and polyhydric alcohols, such as behenic acid monoglyceride; and methyl ester compounds having hydroxy groups obtained by hydrogenation and the like of vegetable oils and fats. One of these waxes may be used alone, or at least two may be combined.

Of these, an aliphatic hydrocarbon wax or a monoester wax consisting primarily of a linear fatty acid ester is preferred. The peak temperature (melting point) of the maximum endothermic peak of the wax as measured by differential scanning calorimetry (DSC) is preferably from 60° C. to 140° C. or more preferably from 60° C. to 90° C. The content of the wax is preferably from 2.5 mass parts to 25.0 mass parts per 100 mass parts of the binder resin.

A charge control agent may also be included in the toner particle to stably maintain the charging performance of the toner particle regardless of the environment. A known charge control agent may be used, and a charge control agent that can provide a rapid charging speed while stably maintained a fixed charge quantity is especially desirable. When the toner particle is manufactured by a direct polymerization method, a charge control agent with low polymerization inhibition and effectively no soluble material in the aqueous medium is especially preferred. In terms of specific compounds, examples of charge control agents providing negative charge include metal compounds of aromatic carboxylic acids such as salicylic acid, alkylsalicylic acid, dialkylsalicylic acid, naphthoic acid and dicarboxylic acid, metal salts or metal complexes of azo dyes and azo pigments, and boron compounds, silicon compounds and calixarenes. Examples of charge control agents providing positive charge include quaternary ammonium salts, polymeric compounds having such quaternary ammonium salts in the side chains, guanidine compounds, nigrosine compounds and imidazole compounds.

One kind of charge control agent may be used, or at least two kinds may be combined. A metal-containing salicylic acid compound is preferred as the charge control agent, and the metal in this case may be aluminum or zirconium. An aluminum salicylate compound is preferred as a charge control agent. However, a resin charge control agent may also be used. Specific examples include polymers or copolymers having sulfonic acid groups, sulfonate salt groups, sulfonic acid ester groups, salicylic acid sites or benzoic acid sites. The content of the charge control agent is preferably from 0.01 mass parts to 20 mass parts, or more preferably from 0.05 mass parts to 10 mass parts per 100 mass parts of the binder resin.

The step (III) is a step of maintaining the resin particle obtained in step (II) in an aqueous medium having a pH higher than the acid dissociation constant pKa of the resin B at at least a temperature of the glass transition temperature of the resin B. As discussed above, because the resin B is a polymer, its molecular movement in the toner particle is slow. Therefore, by performing a step of holding the resin particle in an aqueous medium having a pH higher than the acid dissociation constant pKa of the resin B at at least a temperature of the glass transition temperature (Tg) of the resin B, it is possible to positively cause the resin B to be preferentially located at the toner particle surface.

The holding time is preferably from 30 minutes to 6 hours, or more preferably from 1 hour to 5 hours. The pH of the aqueous medium in the steps before this holding step (III), or in other words in the step (I) and/or step (II), is preferably less than the acid dissociation constant pKa of the resin B so as to preferentially locate the resin B to a suitable extent on the toner particle surface.

In this manufacturing method, a distillation step may also be performed between the step (II) and the step (III). The distillation step is a step to remove volatile impurities such as unreacted polymerizable monomers and by-products. The distillation step may be performed at normal pressure (101,325 Pa) or under reduced pressure (from 0.5 kPa to 0.95 kPa).

In this manufacturing method the dispersion containing the resin particle may also be treated with an acid or alkali after the step (III) in order to remove dispersion stabilizer adhering to the surfaces of the resulting resin particles. At this stage the resin particle is separated into a solid phase by ordinary solid-liquid separation methods, and water may be re-added during this process to wash the resin particle and completely remove the acid or alkali and the dispersion stabilizer dissolved therein. This washing may be repeated several times, and after thorough washing is complete solid-liquid separation may be performed again to obtain the toner particle. The resulting toner particle may then be dried as necessary by known drying methods.

The resulting toner particle may also have an external additive or the like on the surface thereof to impart various properties to the toner. To make it more durable on the toner particle surface, the external additive preferably has a particle diameter that is not more than 1/10 the weight-average particle diameter of the toner particle before addition of the external additive.

Examples of eternal additives include metal oxides such as aluminum oxide, titanium oxide, strontium titanate, cerium oxide, magnesium oxide, chromium oxide, tin oxide and zinc oxide; nitrides such as silicon nitride; carbides such as silicon carbide; inorganic metal salts such as calcium sulfate, barium sulfate and calcium carbonate; fatty acid metal salts such as zinc stearate and calcium stearate; and carbon black and silica.

The content of the external additive is preferably from 0.01 mass parts to 10 mass parts or more preferably from 0.05 mass parts to 5 mass parts per 100 mass parts of the toner particle. One kind of external additive may be used, or multiple kinds may be combined.

From the standpoint of charge stability, it is desirable to use an external additive that has been hydrophobically treated on the surface. Methods of hydrophobic treatment include surface treatment with silane coupling agents such as methyl trimethoxysilane, methyl triethoxysilane, isobutyl trimethoxysilane, dimethyl dimethoxysilane, dimethyl diethoxysilane, trimethyl methoxysilane and hexamethylene disilazane.

The toner may be applied to an image-forming method using a known one-component developing system or two-component developing system. The toner may also be used in any kind of system. Examples include toners for high-speed systems, toners for oilless fixing, toners for cleanerless systems and toners for developing systems in which carrier that has deteriorated in the developing device during long-term use is replenished with fresh carrier.

The methods for measuring the various physical properties of the toner are explained below.

Calculating Surface Unevenness Index

The toner is observed with a scanning electron microscope, and the surface unevenness index of the toner is calculated from formula (1) below using the measurement values from the resulting image.

$$\text{Surface unevenness index} = (\text{area of region surrounded by convex hull of toner} - \text{projected area of toner})/\text{projected area of toner} \quad (1)$$

The specific observation methods and image measurement methods are as follows.

The toner is first enlarged from 100,000 times to 200,000 times using a scanning electron microscope (SEM) "S-4800" (Hitachi). Photographed images are obtained in such a way that toner particles in the range of within ±2.0 μm of the weight-average particle diameter of the toner appear individually in the resulting visual field.

Image processing is applied so that external additives on the toner surface can be ignored in the resulting images, which are then binarized and image processed to calculate the surface unevenness index of the toner.

The binarization conditions are selected appropriately according to the observation apparatus. Using Image-Pro Plus 5.1J (MediaCybernetics) for binarization, the background brightness distribution is removed with a flattening radius of 40 pixels from the Subtract Background menu, and the image is then binarized with a brightness threshold of 50 to obtain a binarized image.

The resulting binarized image is subjected to particle analysis with the Image-Pro Plus 5.1J image analysis software to calculate the surface unevenness index of the toner. The calculation procedures are shown below.

(1) Set scale with [Analyze]–[Set Scale].

(2) Set Sigma (Radius) to 1.7 with [Process]→[Filters]→[Gaussian Blur].

(3) Select "Huang" under [Image]–[Adjust]–[Threshold], enter check for "Dark Background", and determine the threshold by changing the numbers so that the particles are filled in red.

(4) Set Size (Pixcel^2) to 50 to Infinity and set Circularity to 0.0 to 1.00 with [Analyze]→[Analyze Particle]. Enter check for the following 6 items: Display Results, Clear Results, Summarize, Add to Manager, Exclude on edges, Include Holes.

Set "Show" to "Nothing", generating an execution window.

"Total Area" in the resulting "Summary" window is the projected area of the toner.

(5) Input Pixels displayed on particle image window generated by "Duplicate" under [File]→[New]→[Image].

(6) Select ROI Manager, select number corresponding to toner on ROI Manager, and confirm that line in shape of toner appears in black image part of generated window.

(7) Perform [Edit]→[Selection]→[Convex Hull].

(8) Perform [Edit]→[Invert].

(9) Delete yellow frame of selected window (erase yellow frame by clicking once in window), then perform [Edit]→[Invert] again.

(10) Set Size (Pixcel^2) to 5 to Infinity and set Circularity to 0.1 to 1.00 under [Analyze]→[Analyze Particle]. Enter check for the following 6 items: Display Results, Clear Results, Summarize, Add to Manager, Exclude on edges, Include Holes.

Set "Show" to "Nothing", generating an execution window.

The "Total Area" in the resulting "Summary" window is the area of the region surrounded by the convex hull of the toner.

The surface unevenness index of the toner is calculated using the above projected area of the toner and area of the region surrounded by the convex hull of the toner.

This analysis is performed on 100 binarized images, and the calculated average of the resulting surface unevenness indices is given as the "surface unevenness index of toner". The calculated average of the standard deviation of the surface unevenness indices obtained by these measurements is given as the "standard deviation of surface unevenness index of toner".

Calculating Shape Factor SF-1 and Shape Factor SF-2

The shape factor SF-1 and shape factor SF-2 of the toner are calculated by the following methods.

The toner is observed with a scanning electron microscope (SEM) "5-4800" (Hitachi).

In a field enlarged by from 100,000 times to 200,000 times, the projected maximum lengths, projected areas and projected perimeters of 100 toner particles are measured with Image-Pro Plus 5.1J image processing software (MediaCybernetics), and the shape factors SF-1 and shape factors SF-2 are each calculated by the following formulae. The calculated averages of the shape factors SF-1 and shape factors SF-2 of the 100 toner particles are given as the shape factor SF-1 and shape factor SF-2.

$$\text{Shape factor SF-1} = (\text{projected maximum length of toner})2/(\text{projected area of toner}) \times (\pi/4) \times 100$$

$$\text{Shape factor SF-2} = (\text{projected perimeter of toner})2/(\text{projected area of toner})/4\pi \times 100$$

The calculation procedures using the Image-Pro Plus 5.1J software are described below.

(1) Set scale with [Analyze]—[Set Scale].

(2) Set Sigma (Radius) to 1.7 with [Process]→[Filters]→[Gaussian Blur].

(3) Select "Huang" under [Image]—[Adjust]—[Threshold], enter check for "Dark Background", and determine the threshold by changing the numbers so that the particles are filled in red.

(4) Set Size (Pixcel^2) to 50 to Infinity and set Circularity to 0.0 to 1.00 under [Analyze]→[Analyze Particle]. Enter check for the following 6 items: Display Results, Clear Results, Summarize, Add to Manager, Exclude on edges, Include Holes.

Set "Show" to "Nothing", generating an execution window.

"Feret X" in the resulting "Summary" window becomes the projected short diameter of the toner, "Feret Y" becomes the projected maximum length of the toner, and Perim. becomes the projected perimeter of the toner, giving the projected area of the toner. These values are entered into the above formulae to obtain SF-1 and SF-2.

Calculating As and Ac

Given As as the occupied area percentage (%) of the wax in a region defined by the contour of the toner and a line drawn 1.0 μm from the contour in the direction of the toner interior and Ac as the occupied area percentage (%) of the wax in the interior region inwards from the line drawn 1.0 μm from the contour in the direction of the toner interior in a cross-section of the toner observed under a transmission electron microscope, As and Ac are calculated as follows.

The distribution state of the wax in the toner is evaluated by observing a cross-section of the toner under a transmission electron microscope, calculating As and Ac from the cross-sectional areas of domains formed by the wax, and calculating the average of 10 randomly selected toner particles.

In detail, the toner is embedded in visible light-curable embedding resin (D-800, Nisshin EM), cut to a thickness of 60 nm with an ultrasound Ultramicrotome (EMS, Leica), and Ru stained with a vacuum staining apparatus (Filgen) ($RuO_4$ gas, 500 Pa atmosphere, 15 minutes staining).

This is then observed at an acceleration voltage of 120 kV with a transmission electron microscope (H7500, Hitachi). In the toner cross-section under observation, 10 toner particles within ±2.0 μm of the weight-average particle diameter of the toner are selected and photographed.

Image processing software (Photoshop 5.0, Adobe) is used to clearly distinguish the wax domains from regions of the binder resin in the resulting images.

In detail, the wax domains can be distinguished as follows. In the image processing software, the threshold value of the brightness of the enclosed TSM image is set at 160 (out of 255 gradations), and the image is binarized. The wax and the visible light-curable embedding resin (D-800) in the toner become the bright parts, while the parts other than the wax in the toner become the dark parts. The contour of the toner cross-section can be distinguished by the brightness of the toner and the visible light-curable embedding resin.

The image is masked, excluding a region defined by the toner contour and a line drawn 1.0 μm from the contour in the direction of the toner interior (including the 1.0-μm line itself). Specifically, a line is drawn from the center of gravity of the toner cross-section to a point on the contour of the toner cross-section. A position 1.0 μm from the contour in the direction of the center of gravity is then specified on that line. This operation is then performed all around the contour of the toner cross-section, and a region defined by the toner contour and a line drawn 1.0 μm from the contour in the direction of the toner interior is shown clearly. The occupied area percentage of the wax domains in this region is calculated and given as As1. This operation is performed on 10 toner particles, and the calculated average As (area %) of the resulting As values is given.

The occupied area percentage of the wax domains in the interior region inwards from the line drawn 1.0 μm from the contour in the direction of the toner interior relative to the area of this interior region is also calculated and given as Ac1. This operation is performed on 10 toner particles, and the calculated average Ac (area %) of the resulting Ac values is given.

Measuring Glass Transition Temperature (Tg) of Resin

The glass transition temperature (Tg) is measured in accordance with ASTM D3418-82 using a differential scanning calorimeter "Q2000" (TA Instruments). The melting points of indium and zinc are used for temperature correction of the device detector, and the heat of fusion of indium is used to correct the calorific value.

Specifically, 2 mg of resin is weighed exactly and placed in an aluminum pan, and an empty aluminum pan is used for reference. Measurement is performed at a ramp rate of 10° C./min within a temperature range of from 30° C. to 200° C.

During measurement, the temperature is first raised to 200° C., then lowered to 30° C. at a rate of 10° C./min, and then raised again. A specific heat change appears within the temperature range of from 40° C. to 100° C. during this second temperature rise. The point of intersection between the curve of the step change part of glass transition and a line equidistant in the vertical direction between straight lines extending from the baselines before and after the appearance of the specific heat change is defined as the glass transition temperature (Tg: ° C.) of the resin.

Measuring Softening Point of Resin

The softening point (° C.) of the resin is measured using a constant load extrusion type capillary rheometer "flow characteristics evaluation apparatus Flow Tester CFT-500D" (Shimadzu Corp.) in accordance with the manual for the apparatus. With this apparatus, a fixed load is applied from above the measurement sample with a piston, while at the same time the temperature of the measurement sample packed in a cylinder is raised to melt the sample, and the melted measurement sample is extruded through a die at the bottom of the cylinder. This series of steps yields a flow curve showing the relationship between the temperature and the amount of descent of the piston.

In these disclosures, the softening point is the "melting point by the ½ method" described in the manual of the "flow characteristics evaluation apparatus Flow Tester CFT-500D". The melting point by the ½ method is calculated as follows. First, half of the difference between the piston descent Smax at the point when outflow is complete and the piston descent Smin at the start of outflow is calculated and given as X (X=(Smax−Smin)/2). The temperature on the flow curve at which the piston descent is the sum of X and Smin is then given as the melting point by the ½ method.

For the measurement sample, 1.00 g of resin is compression molded for 60 seconds at 10 MPa with a tableting compressor (NT-100H, NPA System) to obtain a cylinder 8 mm in diameter.

The CFT-500D measurement conditions are as follows.

Test mode: Temperature increase method
Initial temperature: 50° C.
Achieved temperature: 200° C.
Measurement interval: 1.0° C.
Ramp rate: 4.0° C./min
Piston cross-sectional area: 1.000 $cm^2$
Test load (piston load): 10.0 kgf (0.9807 MPa)
Pre-heating time: 300 seconds
Die hole diameter: 1.0 mm
Die length: 1.0 mm Measuring Acid Value of Resin and Acid Dissociation Constant pKa of Resin The acid value of the resin is the number of milligrams of potassium hydroxide needed to neutralize the acid contained in 1 g of sample. The acid value of the resin is measured in accordance with JIS K 0070-1992, specifically by the following procedures.

Titration is first performed with an 0.1 mol/L potassium hydroxide ethyl alcohol solution (Kishida Chemical). The factor of the potassium hydroxide ethyl alcohol solution is determined with a potentiometric titration device (Kyoto Electronics Manufacturing, potentiometric titration measurement apparatus AT-510 (product name)). Specifically, 100 mL of 0.100 mol/L hydrochloric acid is taken in a 250 mL tall beaker and titrated with the potassium hydroxide ethyl alcohol solution to determine the amount of the potassium hydroxide ethyl alcohol solution required for neutralization. The 0.100 mol/L hydrochloric acid is prepared in accordance with JIS K 8001-1998. The measurement conditions for acid value measurement are given below.

Titration unit: Potentiometric titration device AT-510 (product name, Kyoto Electronics Manufacturing)
Electrode: Composite glass double-junction electrode (Kyoto Electronics Manufacturing)
Titration unit control software: AT-WIN
Titration analysis software: Tview The titration parameters and control parameters during titration are set as follows.

Titration Parameters
Titration mode: Blank titration
Titration style: Total titration
Maximum titration amount: 20 mL
Waiting time before titration: 30 seconds
Titration direction: Automatic Control Parameters
End point judgment potential: 30 dE
End point judgment potential value: 50 dE/dmL
End point detection determination: Not set
Control speed mode: Standard
Gain: 1
Data collection potential: 4 mV
Data collection titration amount: 0.1 mL Main Test 0.100 g of a measurement sample (resin) is weighed exactly into a 250 mL tall beaker, 150 mL of a mixed toluene/ethanol solution (3:1) is added, and the sample is dissolved over the course of 1 hour. Titration is performed with the above potassium hydroxide ethyl alcohol solution using the above potentiometric titration unit.

Blank Test

Titration is performed as above but without using the sample (with only a mixed toluene/ethanol (3:1) solution). The results are entered into the following formula to calculate the acid value of the resin (Av: unit mg KOH/g).

$$Av=[(C-B)\times f\times 5.61]/S$$

In the formula, Av is the acid value (mg KOH/g), B is the added amount (ml) of the potassium hydroxide ethyl alcohol solution in the blank test, C is the added amount (ml) of the potassium hydroxide ethyl alcohol solution in the main test, f is the factor of the potassium hydroxide ethyl alcohol solution, and S is the mass (g) of the sample (resin). Because pKa is the same value as the pH at half the amount of the 0.1 mol/L potassium hydroxide ethyl alcohol solution required up to the neutralization point, the pH at half the amount is read from the titration curve.

Measuring Particle Diameter of Toner

The particle diameter of the toner is measured using a precision particle size distribution measurement apparatus based on the pore electrical resistance method (product name: Coulter Counter Multisizer 3) together with the dedicated software (product name: Beckman Coulter Multisizer 3 Version 3.51 software, Beckman Coulter). The aperture diameter is set at 100 μm, measurement is performed with 25,000 effective measurement channels, and the data are analyzed.

The aqueous electrolytic solution used for measurement is a solution of special grade sodium chloride dissolved in deionized water to a concentration of about 1 mass %, such as Beckman Coulter Isoton II (product name). The following settings are performed on the dedicated software prior to measurement and analysis.

On the "Change standard operating method (SOM)" screen of the dedicated software, the total count number in control mode is set to 50,000 particles, the number of measurements to 1, and the Kd value to a value obtained using "standard particles 10.0 μm (Beckman Coulter)". The threshold value and noise level are set automatically by pressing the "Threshold/Noise level measurement" button. The current is set to 1,600 μA, the gain to 2 and the electrolytic solution to Isoton II (product name), and a check is entered for "Aperture flush after measurement". On the "Conversion setting from pulse to particle diameter" screen of the dedicated software, the bin interval is set to the logarithmic particle diameter and the particle diameter bins to 256 particle diameter bins, with a particle diameter range from 2 μm to 60 μm. The specific measurement methods are as follows.

(1) 200 mL of the aqueous electrolytic solution is placed in a 250 mL glass round-bottomed beaker dedicated to the Multisizer 3, and this is set in the sample stand and stirred counter-clockwise at a rate of 24 rotations per second of the stirrer rod. Contamination and air bubbles in the aperture tube are removed by the "Aperture flush" function of the dedicated software.

(2) 30 mL of the aqueous electrolytic solution is placed in a 100 mL glass flat-bottomed beaker, and about 0.3 mL of a diluted solution of Contaminon N (product name) (a 10 mass % aqueous solution of a neutral detergent for cleaning precision measurement instruments, manufactured by Wako Pure Chemical Industries) diluted 3 times by mass with deionized water is added thereto.

(3) A predetermined amount of deionized water and about 2 mL of Contaminon N (product name) are placed in the water tank of an ultrasound disperser with an electrical output of 120 W equipped with two built-in oscillators with an oscillation frequency of 50 kHz disposed so that their phases are displaced by 180 degrees (product name: Ultrasonic Dispersion System Tetora 150, Nikkaki Bios).

(4) The beaker of (2) above is set in the beaker fixing hole of the ultrasound disperser, and the ultrasound disperser is operated. The vertical position of the beaker is adjusted so as to maximize the resonance state of the surface of the electrolytic solution in the beaker.

(5) About 10 mg of toner is added bit by bit and dispersed in the aqueous electrolytic solution in the beaker of (4) above as the aqueous electrolytic solution is exposed to ultrasound. Ultrasound dispersion is then continued for another 60 seconds. The water temperature of the water tank is adjusted appropriately so as to be from 10° C. to 40° C. during ultrasound dispersion.

(6) The aqueous electrolytic solution of (5) above containing the dispersed toner is dripped with a pipette into the round-bottomed beaker of (1) above set in the sample stand to adjust the measurement concentration to 5%. Measurement is then performed until the number of measured particles reaches 50,000.

(7) The measurement data is analyzed with the above dedicated software included with the apparatus to calculate the weight-average particle diameter (D4) or number-average particle diameter (D1). The weight-average particle diameter (D4) is the "average diameter" on the "Analysis/volumetric statistical value (arithmetic average)" screen when graph/vol % is set on the dedicated software. The number-average particle diameter (D1) is the "average diameter" on the "Analysis/numerical statistical value (arithmetic average)" screen when graph/number % is set on the dedicated software.

Measuring Average Circularity of Toner

The average circularity of the toner is measured under the measurement and analysis conditions for calibration operations using a flow particle image analyzer "FPIA-3000" (Sysmex). The specific measurement methods are as follows.

First, 20 mL of deionized water from which solid impurities have been removed is placed in a glass vessel. About 0.2 mL of "Contaminon N" (a 10 mass % aqueous solution of a pH 7 neutral detergent for cleaning precision measurement instruments, comprising a nonionic surfactant, an anionic surfactant and an organic builder, manufactured by Wako Pure Chemical Industries) diluted 3 times by mass with deionized water is added thereto as a dispersant. 0.02 g of the measurement sample is then added and dispersed for 2 minutes with an ultrasound disperser to obtain a dispersion for measurement. Cooling is performed appropriately during this process so that the dispersion temperature is from 10° C. to 40° C. Using a desktop ultrasound cleaner and disperser with an oscillation frequency of 50 kHz and an electrical output of 150 W (such as "VS-150", Velvo-Clear) as the disperser, a predetermined amount of deionized water is placed in the water tank, and about 2 mL of the Contaminon N is added to the water tank.

Measurement is performed using a "LUCPLFLN" objective lens (magnification 20×, aperture 0.40) mounted on the above flow-type particle image analyzer, and Particle Sheath "PSE-900A" (Sysmex) is used as the sheath liquid. A dispersion prepared by the above procedures is introduced into the flow-type particle image analyzer, and 2,000 toner particles are measured in HPF measurement mode, total count mode. The average circularity of the toner particles is then determined with the binarization threshold set at 85% during particle analysis, and with the analyzed particle diameters limited to circle-equivalent diameters of from 1.977 μm to less than 39.54 μm.

Prior to the beginning of measurement, automatic focal point adjustment is performed using standard latex particles (Duke Scientific "Research and Test Particles Latex Microsphere Suspensions 5100A", diluted with deionized water). Subsequently, focal point adjustment is preferably performed every 2 hours after the start of measurement.

The flow-type particle image analyzer is one that has been calibrated by Sysmex Corp. and has received a calibration certificate issued by Sysmex Corp. The measurement and analysis conditions for measurement are the same as when the calibration certificate was received except that the analyzed particle diameters are limited to circle-equivalent diameters of from 1.977 μm to less than 39.54 μm.

EXAMPLES

Examples and comparative examples are explained in more detail below. However, these disclosures are not restricted by these examples and comparative examples. Parts and percentages in the examples and comparative examples are based on mass unless otherwise specified.

Resin B: Manufacturing Example of Polyester Resin 1

An acid component and an alcohol component in the amounts shown in Table 1 below were placed in a reaction tank equipped with a nitrogen introduction pipe, a dewatering pipe, a stirrer and a thermocouple, and dibutyl tin was added as a catalyst in the amount of 1.5 parts per 100 parts of the total monomers. The temperature was then quickly raised to 180° C. in a nitrogen atmosphere at normal pressure, after which the mixture was heated from 180° C. to 210° C. at a rate of 10° C./hour as the water was distilled off to perform condensation polymerization. Once the temperature had reached 210° C., the reaction tank was depressurized to not more than 5 kPa, and condensation polymerization was performed under conditions of 210° C., not more than 5 kPa to obtain a polyester resin 1. The polymerization time was adjusted during this process so that the resulting polyester resin 1 had a softening point of 126° C. The physical properties of the resulting polyester resin 1 are shown in Table 1.

Resin B: Manufacturing Examples of Polyester Resins 2 to 5

Polyester resins 2 to 5 were manufactured by the same manufacturing operations as the polyester resin 1 except that the compounded amounts of the acid component and alcohol component were changed as shown in Table 1. The physical properties of the resulting polyester resins 2 to 5 are shown in Table 1.

TABLE 1

| Polyester | Monomer composition: compounded amount (molar ratio) | | | | | | | Physical properties of resin | | |
|---|---|---|---|---|---|---|---|---|---|---|
| | Acid component | | | Alcohol component | | | | Glass transition temperature | Acid | |
| resin No. | TPA | IPA | TMA | BPA-PO | BPA-EO | EG | IS | Tg | value | pKa |
| 1 | 40.0 | 3.6 | 7.4 | 41.0 | 8.0 | — | — | 74 | 15 | 5.3 |
| 2 | 41.0 | 2.6 | 5.0 | 42.0 | 9.0 | — | — | 73 | 6 | 5.4 |
| 3 | 40.0 | 3.0 | 6.0 | 30.0 | 10.0 | 6.0 | — | 74 | 7 | 5.0 |
| 4 | 41.0 | — | 6.0 | 35.0 | — | 10.0 | 5.0 | 72 | 6 | 5.0 |
| 5 | 40.0 | 3.0 | 5.0 | 43.0 | 9.0 | — | — | 77.5 | 6 | 5.3 |

TPA: Terephthalic acid

TMA: Trimellitic anhydride

BPA (PO): Bisphenol A propylene oxide 2-mol adduct

BPA (EO): Bisphenol A ethylene oxide 2-mol adduct

EG: Ethylene glycol

IS: Isosorbitol

The glass transition temperatures in the table are given in units of ° C., and the acid values in units of mg KOH/g.

Manufacturing Example of Toner 1

Preparing Aqueous Medium 100.0 parts of deionized water, 2.0 parts of sodium phosphate and 0.9 parts of hydrochloric acid with a hydrogen chloride concentration of 10 mass % were added to a granulation tank, and heated and maintained at 50° C. An aqueous calcium chloride solution of 1.2 parts of calcium chloride hexahydrate dissolved in 8.2 parts of deionized water was then added thereto. After addition, this was stirred for 30 minutes at a peripheral speed of 25 m/s with a TK Homomixer (Tokushu Kika) to obtain a pH 5.0 aqueous medium containing a hardly water-soluble inorganic fine particle.

Preparing Polymerizable Monomer Composition

Preparing Dispersed Pigment Composition

| | |
|---|---|
| Styrene | 39.0 parts |
| Carbon black (Nipex 35, Evonik Japan) | 6.5 parts |

These materials were introduced into an attritor (Nippon Coke & Engineering) and stirred for 180 minutes at 25° C., 200 rpm with zirconia beads with a radius of 1.25 mm, and the zirconia beads were removed to prepare a dispersed pigment composition.

Preparing Polymerizable Monomer Composition

The following materials were placed in the same container and mixed and dispersed at a peripheral speed of 20 m/s with a TK Homomixer (Tokushu Kika).

| | |
|---|---|
| Dispersed pigment composition | 45.5 parts |
| Styrene | 33.0 parts |
| n-butyl acrylate | 28.0 parts |
| Polyester resin 1 | 5.0 parts |

This was further heated to 60° C., 5.0 parts of hydrocarbon wax (melting point: temperature at maximum endothermic peak: 77° C.) and 9.0 parts of behenyl behenate wax (melting point: temperature at maximum endothermic peak: 72° C.) were added, and the mixture was dispersed and mixed for 30 minutes to obtain a polymerizable monomer composition.

Step (I)

The polymerizable monomer composition was added to the aqueous medium containing the hardly water-soluble inorganic fine particle and stirred at a peripheral speed of 30 m/s with a TK Homomixer (Tokushu Kika) in a nitrogen atmosphere at 60° C. 6.0 parts of the polymerization initiator t-hexyl peroxypivalate (NOF Corp., product name "Perhexyl PV", molecular weight: 202, 10-hour half-life temperature: 53.2° C.) were dissolved therein to prepare a polymerizable monomer composition containing a polymerization initiator.

Step (II)

The dispersion containing particles of the polymerizable monomer composition was transferred to a tank and heated to 70° C. under stirring with a paddle blade, and the polymerizable monomer contained in the particles of the polymerizable monomer composition was subjected to a polymerization reaction for 6 hours. This was then further heated to 90° C. and reacted for 6 hours to form resin particles.

Distillation Step

After completion of the polymerization step, a supply of 120° C. water vapor into the slurry containing the aqueous medium and resin particles was initiated at a flow rate of 30.0 parts/hour. After the start of water vapor supply, distillation was initiated once the temperature reached 98° C. and performed for 8 hours.

Step (III)

After completion of the distillation step, a 7.0% sodium carbonate aqueous solution was added to the slurry containing the aqueous medium and the resin particles to change the pH of the aqueous medium to 8.0. This was then maintained at 80° C. for 1 hour.

Washing, Filtration, Drying and Classification Steps

After completion of step (III) the mixture was cooled, adjusted to pH 1.4 with hydrochloric acid, and stirred for 2 hours to obtain an aqueous dispersion containing a toner particle. The toner particle was filtered out of the aqueous dispersion, water washed, dried for 48 hours at 40° C. and classified to obtain a toner particle 1.

External Addition Step 0.5 parts of a hydrophobic silica particle with a number-average particle diameter of 20 nm of the primary particles that had been surface treated with 25 mass % hexamethyl disilazane were added to 100.0 parts of the toner particle 1 and mixed in a Henschel Mixer (Mitsui Miike, FM-10) to obtain a toner 1. The temperature of the Henschel Mixer was adjusted so that the temperature of the mixture was 30° C.

Matters concerning the main formulation and manufacturing conditions for the toner 1 are shown in Table 2.

TABLE 2

| | Raw materials | | | | | | Manufacturing step | | |
|---|---|---|---|---|---|---|---|---|---|
| | Polyester | | | | | | Step (III) | | |
| Toner | resin No. | | Wax 1 | | Wax 2 | | | Tem- | Holding |
| No. | Type | Parts | Type | Parts | Type | Parts | pH | perature | time |
| 1 | 1 | 5.0 | A | 5.0 | B | 9.0 | 8.0 | 80° C. | 1.0 hour |
| 2 | 1 | 5.0 | A | 4.0 | C | 10.0 | 8.0 | 80° C. | 1.0 hour |
| 3 | 1 | 5.0 | A | 9.0 | B | 5.0 | 8.0 | 80° C. | 1.0 hour |
| 4 | 1 | 5.0 | A | 9.0 | B | 5.0 | 8.0 | 80° C. | 1.0 hour |
| 5 | 1 | 5.0 | A | 14.0 | — | — | 9.8 | 85° C. | 2.0 hours |
| 6 | 1 | 5.0 | A | 14.0 | — | — | 9.8 | 85° C. | 1.0 hour |
| 7 | 1 | 5.0 | A | 14.0 | — | — | 8.0 | 80° C. | 5.0 hours |
| 8 | 2 | 5.0 | A | 14.0 | — | — | 9.8 | 75° C. | 5.0 hours |
| 9 | 1 | 5.0 | A | 14.0 | — | — | 6.7 | 75° C. | 0.5 hours |
| 10 | 1 | 5.0 | A | 14.0 | — | — | 6.7 | 75° C. | 5.0 hours |
| 11 | 3 | 5.0 | A | 14.0 | — | — | 6.5 | 80° C. | 0.5 hours |
| 12 | 4 | 5.0 | A | 14.0 | — | — | 6.5 | 80° C. | 0.5 hours |
| 13 | 4 | 10.0 | A | 14.0 | — | — | 6.5 | 80° C. | 0.5 hours |
| 14 | 4 | 15.0 | A | 14.0 | — | — | 6.5 | 80° C. | 0.5 hours |
| 15 | 4 | 3.0 | A | 14.0 | — | — | 6.5 | 80° C. | 0.5 hours |
| 16 | — | — | A | 14.0 | | — | 8.0 | 80° C. | 1.0 hour |
| 17 | 1 | 5.0 | A | 14.0 | — | — | 8.0 | 80° C. | 0.1 hours |
| 18 | 1 | 5.0 | A | 14.0 | — | — | — | — | — |

In the table, A represents the hydrocarbon wax (melting point: temperature at maximum endothermic peak: 77° C.), B represents behenyl behenate (melting point: 72° C.), and C represents pentaerythritol stearic acid ester (melting point: 72° C.).

Manufacturing Examples of Toners 2 to 18

Toners 2 to 18 were obtained as in the manufacturing example of the toner 1 except that the formulations and manufacturing conditions were changed as shown in Table 2.

Manufacturing Example of Toner 19

Preparation of Resin B Particle Dispersion 1

100.0 parts of the polyester resin 1 and 350 parts of deionized water were placed in a stainless-steel container and heated and melted to 95° C. in a warm bath. This was then stirred thoroughly with a homogenizer (IKA, Ultra-Turrax T50) at 7,800 rpm as 0.1 mol/L sodium hydrogen carbonate was added to raise the pH above 7.0.

A mixed solution of 3 parts of sodium dodecybenzene sulfonate and 300 parts of deionized water was then dripped in gradually to emulsify and disperse the mixture and obtain a polyester resin particle dispersion. The dispersion was cooled to room temperature, and deionized water was added to obtain a resin B particle dispersion 1 with a solid concentration of 12.5 mass % and a volume-based median diameter of 0.2 μm.

Preparation of Resin A Particle Dispersion 2

78.0 parts of styrene, 20.7 parts of n-butyl acrylate, 1.3 parts of acrylic acid as a carboxy group-imparting monomer and 3.2 parts of n-lauryl mercaptane were mixed and dissolved. An aqueous solution containing 1.5 part of Neogen RK (Daiichi Kogyo) in 150 parts of deionized water was added to disperse the mixture.

This was then stirred slowly for a further 10 minutes as an aqueous solution containing 0.3 parts of potassium persulfate in 10 parts of deionized water was added. The system was purged with nitrogen, and emulsification polymerization was performed for 6 hours at 70° C. After completion of polymerization, the reaction solution was cooled to room temperature, and deionized water was added to obtain a resin A particle dispersion 2 with a solid concentration of 12.5 mass % and a volume-based median diameter of 0.2 μm.

Preparing Wax Dispersion 100 parts of hydrocarbon wax (melting point: 77° C.) and 15 parts of Neogen RK were mixed with 385 parts of deionized water and dispersed for about 1 hour with a JN100 wet jet mill (Jokoh) to obtain a wax dispersion. The wax dispersion had a solids concentration of 20 mass %.

Preparing Colorant Dispersion 100 parts of carbon black "Nipex 35 (Orion Engineered Carbons)" and 15 parts of Neogen RK were mixed with 885 parts of deionized water and dispersed for about 1 hour with a JN100 wet jet mill to obtain a colorant dispersion 1.

Preparing Toner Particle

Particle Growth Step 54 parts of the resin B particle dispersion 1, 250 parts of the resin A particle dispersion 2, 20 parts of the wax dispersion and 20 parts of the colorant dispersion were mixed and then dispersed with a homogenizer (IKA, Ultra-Turrax T50). The temperature inside the container wax adjusted to 30° C. under stirring, and a 1 mol/L sodium hydroxide aqueous solution was added to adjust the pH to 8.0 (pH adjustment 1).

A solution of 0.25 parts of aluminum chloride dissolved in 10 parts of deionized water was added as a flocculant under stirring at 30° C. over the course of 10 minutes. This was left for 3 minutes, after which heating was initiated, and the mixture was heated to 50° C. to produce aggregated particles. The particle diameter of the aggregated particles was then measured in this state with a "Coulter Counter Multisizer 3" (registered trademark, Beckman Coulter). Once the weight-average particle diameter reached 6.6 μm, 0.9 parts of sodium chloride and 5.0 parts of Neogen RK were added to stop particle growth.

Spheronization Step 1 mol/L sodium hydroxide aqueous solution was added to adjust the pH to 8.5, after which the temperature was raised to 95° C. and the aggregated particles were spheronized at that temperature for 5 hours. This was then cooled to room temperature to obtain a toner particle dispersion 1.

Washing, Filtration, Drying and Classification Steps

Hydrochloric acid was added to the resulting toner particle dispersion 1 to adjust the pH to not more than 1.5, and the dispersion was left under stirring for 1 hour and then subjected to solid-liquid separation in a pressure filter to obtain a toner cake. This was re-slurried with deionized water to again obtain a dispersion, and then subjected to solid-liquid separation in the same filter unit. Re-slurrying and solid-liquid separation were repeated until the electrical conductivity of the filtrate was not more than 5.0 μS/cm, after which a final solid-liquid separation was performed to obtain a toner cake. The resulting toner cake was dried and then classified with a classifier to a weight-average particle diameter of 6.0 μm to obtain a toner particle 19.

External Addition Step 0.5 parts of a hydrophobic silica particle with a number-average particle diameter of 20 nm of the primary particles that had been surface treated with 25 mass % hexamethyl disilazane were added to 100.0 parts of the toner particle 19 and mixed in a Henschel Mixer (Mitsui Miike, FM-10) to obtain a toner 19. The temperature of the Henschel mixer was adjusted so that the temperature of the mixture was 30° C. Matters concerning the toner 19 manufacturing conditions are shown in Table 3.

TABLE 3

| Toner | Particle growth step Added amount of | Spheronization step | | |
|---|---|---|---|---|
| No. | aluminum chloride | pH | Temperature | Time |
| 19 | 0.25 parts | 8.5 | 95° C. | 5 hours |
| 20 | 1.00 part | 8.5 | 95° C. | 1 hour |
| 21 | 0.25 parts | 8.5 | 95° C. | 1 hour |
| 22 | 0.25 parts | 8.5 | 85° C. | 5 hours |

Manufacturing Examples of Toners 20 to 22

Toners 20 to 22 were obtained as in the manufacturing example of the toner 19 except that the manufacturing conditions were changed as shown in Table 3.

Manufacturing Example of Toner 23

| | |
|---|---|
| Polyester resin 1 (resin B) | 5.0 parts |
| Copolymer of styrene and n-butyl acrylate (resin A) (mass copolymerization ratio (styrene:n-butyl acrylate) = 72:28, peak molecular weight (Mp) = 14,000) | 100.0 parts |
| Methyl ethyl ketone | 80.0 parts |
| Ethyl acetate | 80.0 parts |
| Hydrocarbon wax (melting point: temperature at maximum endothermic peak: 77° C.) | 14.0 parts |
| Carbon black (Nipex 35, Evonik Japan) | 6.0 parts |
| Sodium dodecylbenzene sulfonate | 0.5 parts |

These materials were dispersed for 3 hours with an attritor (Mitsui Kinzoku) and left standing for 72 hours to obtain a mixed colorant dispersion.

Meanwhile, 0.25 parts of aluminum chloride were added to 220 parts of deionized water and heated to 65° C., after which 20 parts of a 1.0 mol/L $CaCl_2$ aqueous solution were added to prepare an aqueous medium. The previous mixed colorant dispersion was added to this aqueous medium and stirred for 15 minutes at 12,000 rpm with a TK Homomixer (Tokushu Kika) in a nitrogen atmosphere at 65° C. to form particles of the mixed colorant dispersion. The internal temperature was then reduced to 30° C., and the mixture was held as is for 12 hours to remove the solvent and obtain an aqueous medium with a dispersed resin particle.

Hydrochloric acid was added to the aqueous medium with the dispersed resin particle to reduce the pH to 1.4, and the dispersant was dissolved by stirring for 1 hour. The dispersion was filtered out with a pressure filter, and the resulting wet resin particle was washed to obtain a toner cake. This toner cake was then pulverized and dried to obtain a toner particle 23.

0.5 parts of a hydrophobic silica particle with a number-average particle diameter of 20 nm of the primary particles that had been surface treated with 25 mass % hexamethyl disilazane were added to 100.0 parts of the toner particle 23 and mixed in a Henschel Mixer (Mitsui Miike, FM-10) to obtain a toner 23. The temperature of the Henschel mixer was adjusted so that the temperature of the mixture was 30° C.

Matters concerning the principal formulation and manufacturing conditions for the toner 23 are shown in Table 4.

TABLE 4

| | Raw materials | | | Solvent removal step |
|---|---|---|---|---|
| Toner No. | Peak molecular weight of resin A | Wax type | Parts | Holding time (hr) |
| 23 | 14000 | A | 14.0 | 12 |
| 24 | 16000 | A | 14.0 | 12 |
| 25 | 18000 | B | 9.0 | 12 |
| 26 | 18000 | A | 14.0 | 12 |
| 27 | 18000 | B | 15.0 | 3 |

In the table, A represents a hydrocarbon wax (melting point: temperature at maximum endothermic peak: 77° C.) and B represents behenyl behenate (melting point: 72° C.).

Manufacturing Examples of Toners 24 to 27

Toners 24 to 27 were obtained as in the manufacturing example of the toner 23 except that the formulations and manufacturing conditions were changed as shown in Table 4.

Manufacturing Example of Toner 28

| | |
|---|---|
| Polyester resin 1 (resin B) | 5.0 parts |
| Copolymer of styrene and n-butyl acrylate (resin A) (mass copolymerization ratio (styrene:n-butyl acrylate) = 72:28, peak molecular weight (Mp) = 17,000) | 100.0 parts |
| Hydrocarbon wax (melting point: temperature at maximum endothermic peak: 77° C.) | 14.0 parts |
| 3,5-di-t-butyl salicylic acid aluminum compound | 1.0 part |
| Carbon black (Nipex 35, Evonik Japan) | 6.0 parts |

This formulation was mixed in a Henschel Mixer (FM-75, Mitsui Miike) and then melt kneaded in a twin-screw kneader (PCM-30, Ikegai) set to a temperature of 120° C. The kneaded product was cooled and coarsely pulverized to not more than 1 mm in a hammer mill to obtain a crushed product. A mechanical pulverizer (T-250, Turbo Kogyo) was used to obtain a pulverized resin particle product from the crushed product.

Spheronization Step

The pulverized resin particle product was spheronized in 280° C. hot air with a Meteorainbow surface modifier (Nippon Pneumatic). It was then classified with an air classifier (Elbo Jet PURO, Matsubo) to obtain a toner particle 28.

0.5 parts of a hydrophobic silica particle with a number-average particle diameter of 20 nm of the primary particles that had been surface treated with 25 mass % hexamethyl disilazane were added to 100.0 parts of the toner particle 28 and mixed in a Henschel Mixer (Mitsui Miike, FM-10) to obtain a toner 28. The temperature of the Henschel mixer was adjusted so that the temperature of the mixture was 30° C.

Matters concerning the manufacturing conditions for the toner 28 are shown in Table 5.

TABLE 5

| Toner No. | Hot air temperature in spheronization step |
|---|---|
| 28 | 280° C. |
| 29 | 235° C. |
| 30 | 210° C. |

Manufacturing Examples of Toners 29 and 30

Toners 29 and 30 were obtained as in the manufacturing example of the toner 28 except that the manufacturing conditions were changed as shown in Table 5.

Manufacturing Example of Toner 31

| | |
|---|---|
| Polyester resin 1 (resin B) | 5.0 parts |
| Copolymer of styrene and n-butyl acrylate (resin A) (mass copolymerization ratio (styrene:n-butyl acrylate) = 72:28, peak molecular weight (Mp) = 16,000) | 100.0 parts |
| Hydrocarbon wax (melting point: temperature at maximum endothermic peak: 77° C.) | 14.0 parts |
| 3,5-di-t-butyl salicylic acid aluminum compound | 1.0 part |
| Carbon black (Nipex 35, Evonik Japan) | 6.0 parts |

This formulation was mixed in a Henschel Mixer (FM-75, Mitsui Miike) and then melt kneaded in a twin-screw kneader (PCM-30, Ikegai) set to 120° C. The kneaded product was cooled and coarsely pulverized to not more than 1 mm in a hammer mill to obtain a crushed product. The crushed product was pulverized twice with a mechanical pulverizer (T-250, Turbo Kogyo) to obtain a pulverized resin particle.

Spheronization Step

The pulverized resin particle was simultaneously spheronized and classified in a Mechanical surface modification apparatus (Faculty F-400, Hosokawa Micron) with the distributed rotor with stator rotating at 12,000 rpm and the classifying rotor rotating at 6,000 rpm to obtain a toner particle 31.

0.5 parts of a hydrophobic silica particle with a number-average particle diameter of 20 nm of the primary particles that had been surface treated with 25 mass % hexamethyl disilazane were added to 100.0 parts of the toner particle 31 and mixed in a Henschel Mixer (Mitsui Miike, FM-10) to obtain a toner 31. The temperature of the Henschel mixer was adjusted so that the temperature of the mixture was 30° C.

Matters concerning the manufacturing conditions for the toner 31 are shown in Table 6.

TABLE 6

| Toner No. | Distributed rotor rotation | Classifying rotor rotation |
|---|---|---|
| 31 | 12000 rpm | 6000 rpm |
| 32 | 6000 rpm | 6000 rpm |

Manufacturing Example of Toner 32

Toner 32 was obtained as in the manufacturing example of the toner 31 except that the manufacturing conditions were changed as shown in Table 6.

Manufacturing Example of Toner 33

Preparation of Aqueous Medium 100.0 parts of deionized water, 2.0 parts of sodium phosphate and 0.9 parts of hydrochloric acid with a hydrogen chloride concentration of 10 mass % were added to a granulation tank, and heated and maintained at 50° C. A calcium chloride aqueous solution of 1.2 part of calcium chloride hexahydrate in 8.2 parts of deionized water was added thereto. After addition, this was stirred for 30 minutes at a peripheral speed of 25 m/s with a TK Homomixer (product name, Tokushu Kika) to obtain a pH 5.0 aqueous solution containing a hardly soluble inorganic fine particle.

Preparing Polymerizable Monomer Composition

Preparing Dispersed Pigment Composition

| | |
|---|---|
| Styrene | 39.0 parts |
| Carbon black (Nipex 35, Evonik Japan) | 6.5 parts |

These materials were introduced into an attritor (Nippon Coke & Engineering) and stirred for 180 minutes at 25° C., 200 rpm with zirconia beads with a radius of 1.25 mm, and the zirconia beads were removed to prepare a dispersed pigment composition.

Preparing Polymerizable Monomer Composition

The following materials were placed in the same container and mixed and dispersed at a peripheral speed of 20 m/s with a TK Homomixer (Tokushu Kika).

| | |
|---|---|
| Dispersed pigment composition | 46.0 parts |
| Styrene | 31.0 parts |
| n-butyl acrylate | 30.0 parts |
| Polyester resin 5 | 2.0 parts |

This was further heated to 60° C., 10.0 parts of behenyl behenate (melting point: temperature at maximum endothermic peak: 72° C.) were added, and the mixture was dispersed and mixed for 30 minutes to obtain a polymerizable monomer composition.

Step (I)

The polymerizable monomer composition was added to the aqueous medium containing the hardly water-soluble inorganic fine particle and stirred at a peripheral speed of 30 m/s with a TK Homomixer (Tokushu Kika) in a nitrogen atmosphere at 60° C. 6.0 parts of the polymerization initiator t-butyl peroxypivalate (NOF Corp., product name "Perbutyl PV", molecular weight: 202, 10-hour half-life temperature: 53.2° C.) were dissolved therein to prepare a polymerizable monomer composition containing a polymerization initiator.

Step (II)

The dispersion containing particles of the polymerizable monomer composition was transferred to a tank and heated to 70° C. under stirring with a paddle blade, and the polymerizable monomer contained in the particles of the polymerizable monomer composition was subjected to a polymerization reaction for 6 hours. This was then further heated to 80° C. and reacted for 6 hours to form resin particles. The pH of the polymer slurry at this point was 5.0. Aluminum chloride was then added at 80° C. to a concentration of 2.0 mmol/L and stirring was continued for 2 hours under the same conditions.

Distillation Step

After completion of the polymerization step, a supply of 120° C. water vapor into the slurry containing the aqueous medium and resin particles was initiated at a flow rate of 30.0 parts/hour. After the start of water vapor supply, distillation was initiated once the temperature reached 98° C. and performed for 8 hours.

Step (III)

After completion of the distillation step, a 7.0% sodium carbonate aqueous solution was added to the slurry containing the aqueous medium and the resin particles to change the pH of the aqueous medium to 8.0. This was then maintained at 80° C. for 30 minutes.

Washing, Filtration, Drying and Classification Steps

After completion of step (III) the mixture was cooled, adjusted to pH 1.4 with hydrochloric acid, and stirred for 2 hours to obtain an aqueous dispersion containing a toner particle. The toner particle was filtered out of the aqueous dispersion, water washed, dried for 48 hours at 40° C. and classified to obtain a toner particle 33.

External Addition Step

The external addition step was performed as in the manufacturing example of the toner 1.

The physical properties of the toners 1 to 33 are shown in Table 7.

TABLE 7

| | Physical properties of toner | | | | | | |
|---|---|---|---|---|---|---|---|
| Toner No. | Weight-average particle diameter [μm] | Average circularity | SF-1 | SF-2 | Surface unevenness index | Standard deviation | As/(Ac + As) × 100 |
| 1 | 6.6 | 0.980 | 107 | 112 | 0.024 | 0.005 | 15.1 |
| 2 | 6.6 | 0.980 | 109 | 113 | 0.028 | 0.005 | 32.1 |

TABLE 7-continued

| Toner No. | Physical properties of toner | | | | | | |
|---|---|---|---|---|---|---|---|
| | Weight-average particle diameter [μm] | Average circularity | SF-1 | SF-2 | Surface unevenness index | Standard deviation | As/(Ac + As) × 100 |
| 3 | 6.6 | 0.980 | 109 | 112 | 0.019 | 0.004 | 6.8 |
| 4 | 6.6 | 0.980 | 108 | 110 | 0.025 | 0.005 | 8.8 |
| 5 | 6.6 | 0.980 | 110 | 106 | 0.041 | 0.009 | 3.0 |
| 6 | 6.6 | 0.980 | 108 | 106 | 0.043 | 0.010 | 2.9 |
| 7 | 6.6 | 0.980 | 111 | 105 | 0.038 | 0.019 | 4.2 |
| 8 | 6.6 | 0.980 | 110 | 119 | 0.050 | 0.031 | 4.0 |
| 9 | 6.6 | 0.980 | 108 | 107 | 0.010 | 0.003 | 3.0 |
| 10 | 6.6 | 0.979 | 110 | 118 | 0.012 | 0.003 | 2.9 |
| 11 | 6.6 | 0.975 | 121 | 114 | 0.018 | 0.012 | 4.2 |
| 12 | 6.6 | 0.980 | 110 | 110 | 0.010 | 0.013 | 4.0 |
| 13 | 6.6 | 0.980 | 110 | 110 | 0.015 | 0.015 | 3.0 |
| 14 | 6.6 | 0.980 | 110 | 110 | 0.020 | 0.024 | 2.5 |
| 15 | 6.6 | 0.980 | 110 | 110 | 0.010 | 0.013 | 4.0 |
| 16 | 6.6 | 0.975 | 115 | 106 | 0.007 | 0.012 | 3.6 |
| 17 | 6.6 | 0.982 | 105 | 108 | 0.008 | 0.007 | 2.5 |
| 18 | 6.6 | 0.988 | 102 | 104 | 0.003 | 0.003 | 3.3 |
| 19 | 6.6 | 0.979 | 117 | 125 | 0.030 | 0.016 | 13.8 |
| 20 | 6.6 | 0.966 | 131 | 168 | 0.034 | 0.017 | 20.4 |
| 21 | 6.6 | 0.971 | 122 | 127 | 0.048 | 0.029 | 14.1 |
| 22 | 6.6 | 0.959 | 138 | 134 | 0.090 | 0.330 | 20.8 |
| 23 | 6.6 | 0.981 | 125 | 105 | 0.005 | 0.010 | 11.1 |
| 24 | 6.6 | 0.975 | 133 | 119 | 0.007 | 0.014 | 9.8 |
| 25 | 6.6 | 0.965 | 126 | 135 | 0.040 | 0.021 | 20.9 |
| 26 | 6.6 | 0.965 | 138 | 125 | 0.060 | 0.026 | 10.3 |
| 27 | 6.6 | 0.952 | 138 | 149 | 0.201 | 0.120 | 29.4 |
| 28 | 6.6 | 0.985 | 138 | 105 | 0.006 | 0.012 | 23.4 |
| 29 | 6.6 | 0.979 | 140 | 120 | 0.009 | 0.016 | 19.8 |
| 30 | 6.6 | 0.975 | 141 | 125 | 0.012 | 0.020 | 14.0 |
| 31 | 6.6 | 0.960 | 150 | 131 | 0.041 | 0.020 | 8.6 |
| 32 | 6.6 | 0.952 | 152 | 136 | 0.065 | 0.024 | 7.5 |
| 33 | 6.6 | 0.978 | 112 | 110 | 0.008 | 0.007 | 14.0 |

Example 1

The following evaluations were performed using the toner 1. A commercial color laser printer (HP Color LaserJet Enterprise M855) was modified for use in the evaluations. The four modifications were as follows.

(1) Modified to allow operation with only a single-color toner cartridge and imaging drum installed.

(2) Process speed modified to 55 ppm.

(3) Fixing unit able to be changed any temperature.

(4) Developing roller of imaging drum and gears around toner supply roller part modified to allow rotational direction of developing roller and toner supply roller part to be switched from same-direction rotation to opposite-direction rotation.

The toner was removed from a black toner cartridge and an imaging drum that had been mounted on this color laser printer, the insides were cleaned by air blowing, 425 g of the toner 1 was introduced into the toner cartridge, 127 g of the toner 1 was also introduced into the image drum, the toner cartridge and image drum filled with the toner were mounted on the unit, and the following evaluations were performed. The specific image evaluation items were as follows.

Image Fogging 30,000 sheets of a horizontal line image with a print percentage of 1% were printed out in a low-temperature low-humidity environment (15° C., 10% RH) and a high-temperature high-humidity environment (33° C., 85% RH), and left for 48 hours. One more image was then printed out, and the reflectance (%) of the non-image part of this image was measured with a "Reflectometer Model TC-6DS" (Tokyo Denshoku).

The resulting reflectance value was subtracted from the reflectance (%) measured in the same way on unused printout paper (plain paper) to obtain a value (%) that was evaluated according to the following standard. The smaller the value, the more image fogging has been suppressed. The evaluation was performed in gloss paper mode using plain paper (HP Brochure Paper 200 g, Glossy, HP Corp., 200 g/m$^2$).

Evaluation Standard

A: Less than 0.5%

B: At least 0.5% and less than 1.5%

C: At least 1.5% and less than 3.0%

D: At least 3.0%

Contamination of Member

An initial half-tone image was output in a high-temperature high-humidity environment (33° C., 85% RH), and the absence of density non-uniformity on the image was confirmed. 50,000 sheets of a vertical line image with a print percentage of 30% were then printed out. In this evaluation, a cartridge whose capacity had been exhausted was replaced with a newly prepared toner cartridge in the course of the test.

After 50,000 sheets had been printed out, a half-tone image was output, and the absence of density non-uniformity between the printed image part and the non-printed image part of the half tone image was observed visually. The developing blade was then taken out, the toner in the contact part between the developing roller and the developing blade was blown with air, and the developing blade was observed. The results of observation were evaluated according to the following standard.

Evaluation Standard

A: No density non-uniformity on image, developing blade good

B: No density non-uniformity on image, but some filming confirmed on developing blade C: Slight density non-uniformity on image D: Severe density non-uniformity on image Fine Line Reproducibility Fine line reproducibility was evaluated in a normal-temperature normal-humidity environment (25° C., 50% RH). 20,000 sheets of a vertical line image with a print percentage of 30% were printed out, then a grid pattern with a line width of 3 pixels was printed on the entire surface of A4 paper with a printing area ratio of 4%, and fine line reproducibility was evaluated by the following standard.

A 3-pixel line width is theoretically 127 μm. The line width of the actual image was measured with a microscope VK-8500 (product name, Keyence). The line width was measured at 5 randomly selected points, the average value at three points excluding the minimum and maximum values was given as d (μm), and the fine line reproducibility index L was calculated and evaluated according to the standard below.

$$L(\mu m)=|127-d|$$

L defines the difference between the theoretical line width of 127 μm and the line width d on the output image. Because d may be either larger or smaller than 127, the difference is defined as an absolute value. The smaller the value of L, the better the fine line reproducibility.

Evaluation Standard

A: L is at least 0 μm and less than 5 μm.

B: L is at least 5 μm and less than 15 μm, and slight variation in line width is observable.

C: L is at least 15 μm and less than 30 μm, and thin lines and spatters are observed, but at a tolerable level for actual use.

D: L is at least 30 μm, and fine lines are broken or thickened in some places.

The results for Example 1 are shown in Table 8. As shown in Table 8, the results in Example 1 were all good.

Examples 2 to 12

Evaluations were performed by the methods used to evaluate the toner 1 except that the toner 1 was replaced with the toners shown in Table 8. The evaluation results are shown in Table 8.

Comparative Examples 1 to 18

Evaluations were performed by the methods used to evaluate the toner 1 except that the toner 1 was replaced with the toners shown in Table 8. The evaluation results are shown in Table 8.

TABLE 8

| | Toner No. | Image fogging (low-temperature low-humidity) | Image fogging (high-temperature high-humidity) | Member contamination | Fine line reproducibility |
|---|---|---|---|---|---|
| Example 1 | 1 | A(0.3) | B(0.8) | A | A |
| Example 2 | 2 | A(0.2) | B(0.7) | B | A |
| Example 3 | 3 | A(0.3) | A(0.3) | A | A |
| Example 4 | 4 | A(0.4) | A(0.2) | A | A |
| Example 5 | 5 | A(0.3) | A(0.4) | A | A |
| Example 6 | 6 | A(0.2) | A(0.4) | A | A |
| Example 7 | 7 | B(0.8) | A(0.3) | A | B |
| Example 8 | 8 | B(0.9) | A(0.3) | B | C |
| Example 9 | 9 | B(0.7) | A(0.4) | A | A |
| Example 10 | 10 | B(0.8) | A(0.3) | A | A |
| Example 11 | 11 | C(1.9) | B(0.9) | A | C |
| Example 12 | 12 | C(2.4) | A(0.3) | A | C |
| Example 13 | 13 | C(1.9) | A(0.2) | A | C |
| Example 14 | 14 | C(1.8) | A(0.2) | B | C |
| Example 15 | 15 | C(2.4) | A(0.3) | A | C |
| Comparative Example 1 | 19 | C(2.0) | B(1.3) | B | D |
| Comparative Example 2 | 20 | C(2.0) | C(2.2) | D | D |
| Comparative Example 3 | 21 | B(1.4) | C(2.4) | C | D |
| Comparative Example 4 | 22 | B(1.3) | C(2.6) | D | D |
| Comparative Example 5 | 23 | D(3.4) | B(1.3) | A | C |
| Comparative Example 6 | 24 | D(4.0) | B(1.3) | A | D |
| Comparative Example 7 | 25 | C(1.8) | C(1.9) | D | D |
| Comparative Example 8 | 26 | B(1.3) | B(1.3) | D | D |
| Comparative Example 9 | 27 | B(1.2) | D(4.0) | D | D |
| Comparative Example 10 | 28 | D(4.2) | C(1.8) | C | D |
| Comparative Example 11 | 29 | D(4.2) | C(1.9) | C | D |
| Comparative Example 12 | 30 | C(2.2) | C(2.8) | C | D |
| Comparative Example 13 | 31 | C(2.5) | B(1.4) | D | D |
| Comparative Example 14 | 32 | C(1.9) | B(1.2) | D | D |
| Comparative Example 15 | 16 | D(4.0) | B(1.3) | A | A |
| Comparative Example 16 | 17 | D(3.4) | B(1.2) | A | A |
| Comparative Example 17 | 18 | D(3.4) | B(1.3) | A | A |
| Comparative Example 18 | 33 | D(3.1) | B(1.2) | B | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-068617, filed Apr. 6, 2020 which is hereby incorporated by reference herein in its entirety.

What is claimed is:

1. A toner, comprising:

a toner particle, the toner particle comprising a binder resin and having protrusions on a surface thereof;

the binder resin comprising a resin A and a resin B;

resin A comprising a styrene (meth)acrylic resin;

resin B comprising a polyester resin having an acid dissociation constant pKa of less than 6.5, the polyester resin being 3.0 to 15.0 mass parts with respect to 100.0 mass parts of resin A; and each of the protrusions comprises resin B, wherein when observed under a scanning electron microscope the toner has (i) a shape factor SF-2 of 105 to 120, and (ii) a surface unevenness index of 0.010 to 0.050 where surface unevenness index=(area of region surrounded by convex hull of toner−projected area of toner)/projected area of toner.

2. The toner according to claim 1, which has a shape factor SF-1 of 105 to 120 observed under the scanning electron microscope.

3. The toner according to claim 1, wherein the surface unevenness index has a standard deviation of not more than 0.010.

4. The toner according to claim 1, wherein the toner particle comprises a wax, and in a toner cross-section observed under a transmission electron microscope $50.0 \geq [As/(Ac+As)] \times 100 \geq 3.0$ when As is an occupied area percentage of the wax in a region defined by a contour of the toner and by a line drawn 1.0 μm from the contour toward an interior of the toner, and Ac is an occupied area percentage of the wax in an interior region inwards from the line drawn 1.0 μm from the contour toward the toner interior.

5. A method for manufacturing a toner comprising a toner particle, the toner particle comprising a binder resin and having protrusions on a surface thereof;

the binder resin comprising a resin A and a resin B;

resin A comprising a styrene (meth)acrylic resin;

resin B comprising a polyester resin having an acid dissociation constant pKa of less than 6.5, the polyester resin being 3.0 to 15.0 mass parts with respect to 100.0 mass parts of resin A; and each of the protrusions comprises resin B, wherein when observed under a scanning electron microscope the toner has (i) a shape factor SF-2 of 105 to 120, and (ii) a surface unevenness index of 0.010 to 0.050 where surface unevenness index=(area of region surrounded by convex hull of toner−projected area of toner)/projected area of toner, the manufacturing method comprising:

a step (I) of forming particles of a polymerizable monomer composition comprising resin B and a polymerizable monomer for forming resin A in an aqueous medium;

a step (II) of polymerizing in the aqueous medium the polymerizable monomer contained in the particles of the polymerizable monomer composition to form a resin particle; and a step (III) of maintaining the resin particle at a temperature of at least a glass transition temperature of the resin B in an aqueous medium having a pH higher than an acid dissociation constant pKa of resin B.

6. The method for manufacturing a toner according to claim 5, wherein the resin particle is maintained at a temperature of at least the glass transition temperature of resin B for at least 30 minutes.

7. The method for manufacturing a toner according to claim 5, wherein resin B has an acid value of at least 10 mg KOH/g.

8. The method for manufacturing a toner according to claim 5, wherein the polyester resin has an acid dissociation constant of less than 6.5 and the aqueous medium has a pH of 6.5 to 10.0 in step (III).

* * * * *